US007317433B2

(12) United States Patent
Chen et al.

(10) Patent No.: US 7,317,433 B2
(45) Date of Patent: Jan. 8, 2008

(54) CIRCUIT FOR DRIVING AN ELECTRONIC COMPONENT AND METHOD OF OPERATING AN ELECTRONIC DEVICE HAVING THE CIRCUIT

(75) Inventors: Zhining Chen, Goleta, CA (US); Matthew Stevenson, Santa Maria, CA (US); Gang Yu, Santa Barbara, CA (US); Weixiao Zhang, Goleta, CA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 233 days.

(21) Appl. No.: 10/893,211

(22) Filed: Jul. 16, 2004

(65) Prior Publication Data

US 2006/0012310 A1 Jan. 19, 2006

(51) Int. Cl.
*G09G 3/30* (2006.01)
*G09G 3/34* (2006.01)

(52) U.S. Cl. ..... 345/76; 345/84; 315/169.3

(58) Field of Classification Search ..... 345/76–84; 315/169.3

See application file for complete search history.

(56) References Cited

U.S. PATENT DOCUMENTS

| | | | | |
|---|---|---|---|---|
| 6,545,652 | B1 * | 4/2003 | Tsuji | 345/82 |
| 6,734,636 | B2 | 5/2004 | Sanford et al. | |
| 6,873,309 | B2 * | 3/2005 | Suzuki et al. | 345/76 |
| 7,091,937 | B2 * | 8/2006 | Nakamura | 345/76 |
| 7,116,291 | B1 * | 10/2006 | Suzuki et al. | 345/76 |
| 2002/0195968 | A1 | 12/2002 | Sanford et al. | |
| 2003/0052614 | A1 | 3/2003 | Howard | |
| 2003/0094616 | A1 | 5/2003 | Andry et al. | |
| 2003/0095087 | A1 | 5/2003 | Libsch et al. | |
| 2003/0107565 | A1 | 6/2003 | Libsch et al. | |
| 2004/0061671 | A1 | 4/2004 | Kawasaki et al. | |
| 2004/0174349 | A1 | 9/2004 | Libsch et al. | |
| 2005/0007316 | A1 * | 1/2005 | Akimoto et al. | 345/76 |
| 2005/0140599 | A1 * | 6/2005 | Lee et al. | 345/76 |
| 2005/0146489 | A1 * | 7/2005 | Lai et al. | 345/76 |

FOREIGN PATENT DOCUMENTS

WO WO 2004/015667 A1 2/2004

* cited by examiner

*Primary Examiner*—Richard Hjerpe
*Assistant Examiner*—M. Fatahiyar
(74) *Attorney, Agent, or Firm*—John H. Lamming

(57) ABSTRACT

In one embodiment, a circuit for driving an electronic component includes a first signal line and a first switch. The first switch is connected to the first signal line and is coupled to a first terminal of the electronic component. The first switch is configured to allow a state where the first signal line electrically floats. In another embodiment, a circuit for driving an electronic component includes a first switch and a second switch. In yet another embodiment, a method for using any or all of the circuits includes electrically floating a second terminal of the electronic component, a source/drain region of a field-effect transistor, or both. In yet a further embodiment, during a first time period having a first switch at a first setting and a second switch at a second setting. During a second time period, changing the first switch, the second switch, or both to different setting(s).

18 Claims, 12 Drawing Sheets

CIRCUIT FOR DRIVING AN ELECTRONIC COMPONENT AND METHOD OF OPERATING AN ELECTRONIC DEVICE HAVING THE CIRCUIT

BACKGROUND OF THE INVENTION

1. Field of the Invention

This invention relates in general to circuits and methods of operating electronic devices, and more particularly, to circuits for driving an electronic component and methods of operating electronic devices including the circuits.

2. Description of the Related Art

Organic electronic devices have attracted considerable attention since the early 1990's. Examples of organic electronic devices include Organic Light-Emitting Diodes ("OLEDs"), which include Polymer Light-Emitting Diodes ("PLEDs") and Small Molecule Organic Light-Emitting Diodes ("SMOLEDs"). Display devices, including OLED displays, have played an important role in modern human life. As computing, telecommunications, home entertainment, and networking technologies converge, the display unit will become more important.

In the display area, there are many kinds of technologies including cathode ray tube ("CRT"), liquid crystal display ("LCD"), inorganic LED displays, and so on. LCD and inorganic LED displays may include transistors within pixel circuits. Metal-insulator-semiconductor field-effect transistors ("MISFETs") may be susceptible to changes in threshold voltage due to charges that become trapped within a gate dielectric layer. In the case of LCD and inorganic LED displays, the transistors within driver circuits are on for relatively short amounts of time, and therefore, changes in threshold voltages are not a significant problem in LCD and inorganic LED displays. However, power transistors within driver circuits for OLED technologies can be on for substantially longer times.

FIGS. 1-3 illustrate circuit diagrams of electronic devices 100, 200, and 300, respectively. Each of the electronic devices 100, 200, and 300 includes an electronic component 110, which in one embodiment is an OLED. The electronic component 110 is connected to a field-effect transistor 102, which has a gate dielectric layer that is susceptible to trapping charge. In FIG. 1, the gate electrode of the field-effect transistor 102 is connected to a data holder unit 104, which is connected to a select unit 106. The data holder unit 104 may include a capacitive electronic component having one electrode connected to a first power supply line (e.g., $V_{dd}$) and the other electrode connected to the gate electrode of the field-effect transistor 102. The select unit 106 may include a transistor or switch. An optional anti-degradation unit (not shown) may be used and typically is connected to a power supply line and the data holder unit 104.

In FIG. 2, the data holder unit 204 includes a capacitive electronic component having one electrode connected to the gate electrode of the field-effect transistor 102 and the other electrode connected to an anode of the electronic component 110. FIG. 3 is similar to FIG. 2 except that the electronic component 110 is connected to the first power supply line, and the data holder unit 304 is connected to a second power supply line (e.g., $V_{ss}$).

Unlike MISFETs in LCD or inorganic LED displays, the field-effect transistor 102 in FIGS. 1-3 is on for substantially longer periods of time when the electronic component 110 is an OLED. For example, in an LCD display, a MISFET used within the driver circuit is on for approximately 0.1% of the time, whereas in an organic electronic device, the field-effect transistor 102 can be on substantially all the time. The optional anti-degradation unit addresses degradation of the organic material within the electronic component 110 but does not address the threshold voltage shift seen with field-effect transistors.

SUMMARY OF THE INVENTION

In one embodiment, a circuit for driving an electronic component includes a first signal line and a first switch. The electronic component is a radiation-emitting electronic component or a radiation-responsive electronic component. The first switch is connected to the first signal line and is coupled to a first terminal of the electronic component. The first switch is configured to allow a state where the first signal line electrically floats.

In another embodiment, a circuit for driving an electronic component includes a first signal line, a first switch, a second signal line and a second switch. The electronic component is a radiation-emitting electronic component or a radiation-responsive electronic component. The first switch includes a first terminal and second terminals. The first terminal of the first switch is connected to the first signal line and coupled to a first terminal of the electronic component. The first switch is configured to allow connection of the first terminal of the first switch to at least one of the second terminals of the first switch. The second switch includes a third terminal and fourth terminals. The third terminal of the second switch is connected to the second signal line and coupled to a second terminal of the electronic component. The second switch is configured to allow connection of the third terminal of the second switch to at least one of the fourth terminals of the second switch.

In still another embodiment, a method is used for operating an electronic device. The electronic device includes a field-effect transistor including a first source/drain region and a second source/drain region. The first source/drain region is connected to a first terminal of an electronic component. The electronic component is a radiation-emitting electronic component or a radiation-responsive electronic component. The method includes, during a first time period, sending a first signal to one of a second terminal of the electronic component or the second source/drain region. The method also includes, during a second time period, electrically floating the second terminal of the electronic component, the second source/drain region, or both.

In a further embodiment, a method is used for operating an electronic device. The electronic device includes a field-effect transistor including a gate dielectric layer, a first source/drain region, and a second source/drain region. The first source/drain region is connected to a first terminal of an electronic component. The electronic component is a radiation-emitting electronic component or a radiation-responsive electronic component. The method includes, during a first time period, sending a first signal to one of a second terminal of the electronic component or a second source/drain region and sending a second signal to a gate electrode. The method also includes, during a second time period, sending a third signal to the second terminal of the electronic component or the second source/drain region, or both, wherein the third signal is different from the first signal and keeping the second signal on the gate electrode.

The foregoing general description and the following detailed description are exemplary and explanatory only and are not restrictive of the invention, as defined in the appended claims.

BRIEF DESCRIPTION OF THE DRAWINGS

The invention is illustrated by way of example and not limitation in the accompanying figures.

Figure 1:
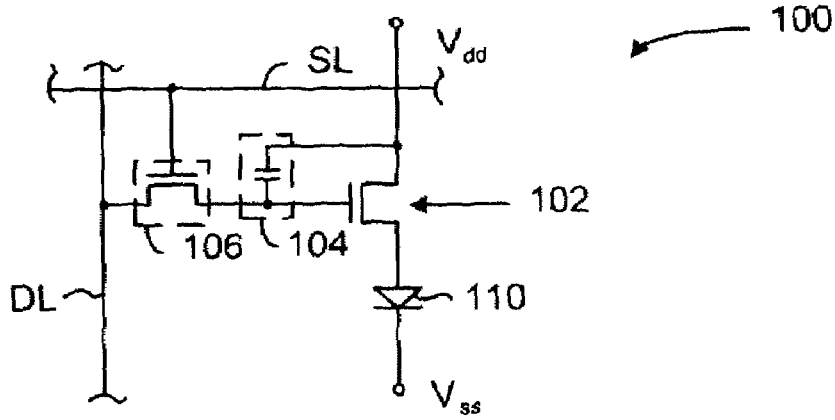
FIG. 1 (Prior Art)
FIG. 1-3 include circuit diagrams of conventional electronic devices. (Prior art).
Figure 2:
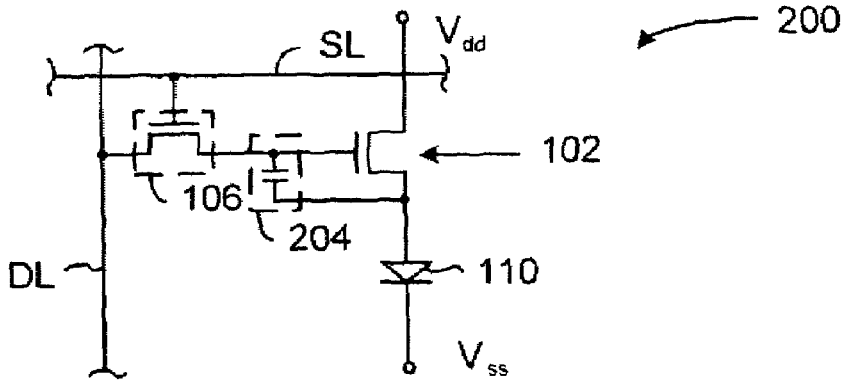
FIG. 2 (Prior Art)
Figure 3:
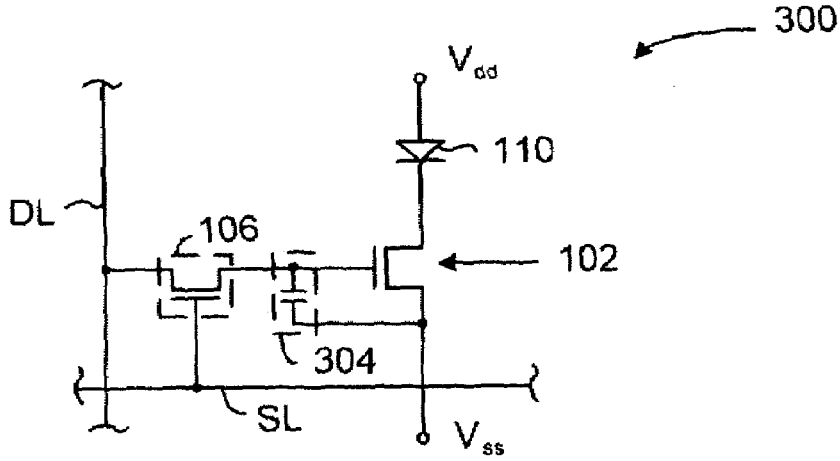
FIG. 3 (Prior Art)

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

In one embodiment, a circuit for driving an electronic component includes a first signal line and a first switch. The electronic component is a radiation-emitting electronic component or a radiation-responsive electronic component. The first switch is connected to the first signal line and is coupled to a first terminal of the electronic component. The first switch is configured to allow a state where the first signal line electrically floats.

In another embodiment, the circuit further includes a field-effect transistor including a gate electrode, a gate dielectric layer, a first source/drain region, and a second source/drain region. The gate electrode is coupled to a data line. The first source/drain region is connected to a first terminal of the electronic component.

In a specific embodiment, the circuit further includes a data holder unit having a first terminal and a second terminal. The first terminal of the data holder unit is connected to the gate electrode. The second terminal of the data holder unit is coupled to the first source/drain region or the second source/drain region.

In still a more specific embodiment, the first terminal of the first switch is connected to the second source/drain region and the second terminal of the data holder unit. A second terminal of the electronic component is connected to a second signal line. In another more specific embodiment, the first terminal of the first switch is connected to a second terminal of the electronic component. The second source/drain region is connected to a second signal line.

In still another embodiment, the circuit further includes a second signal line and a second switch including a first terminal and second terminals. The first terminal of the second switch is connected to the second signal line and coupled to a second terminal of the electronic component. The second switch is configured to allow connection of the first terminal of the second switch to at least one of the second terminals of the second switch.

In one embodiment, a circuit for driving an electronic component includes a first signal line, a first switch, a second signal line and a second switch. The electronic component is a radiation-emitting electronic component or a radiation-responsive electronic component. The first switch includes a first terminal and second terminals. The first terminal of the first switch is connected to the first signal line and coupled to a first terminal of the electronic component. The first switch is configured to allow connection of the first terminal of the first switch to at least one of the second terminals of the first switch. The second switch includes a third terminal and fourth terminals. The third terminal of the second switch is connected to the second signal line and coupled to a second terminal of the electronic component. The second switch is configured to allow connection of the third terminal of the second switch to at least one of the fourth terminals of the second switch.

In another embodiment, the first switch, the second switch, or a combination thereof is configured to allow a state where the first signal line, the second signal line, or a combination thereof electrically floats.

In yet another embodiment, the circuit further includes a field-effect transistor including a gate electrode, a gate dielectric layer, a first source/drain region, and a second source/drain region. The gate electrode is coupled to a data line. The first source/drain region is connected to a first terminal of the electronic component. The second source/drain region is connected to the second signal line. The second terminal of the electronic component is connected to the first signal line.

In a more specific embodiment, the circuit further includes a data holder unit having a first terminal and a second terminal. The first terminal of the data holder unit is connected to the gate electrode. The second terminal of the data holder unit is coupled to the first source/drain region or the second source/drain region.

In one embodiment, a method is used for operating an electronic device. The electronic device includes a field-effect transistor including a first source/drain region and a second source/drain region. The first source/drain region is connected to a first terminal of an electronic component. The electronic component is a radiation-emitting electronic component or a radiation-responsive electronic component. The method includes, during a first time period, sending a first signal to one of a second terminal of the electronic component or the second source/drain region. The method also includes, during a second time period, electrically floating the second terminal of the electronic component, the second source/drain region, or both.

In another embodiment, during the first time period, if the electronic component is a radiation-emitting electronic component, the electronic component is emitting radiation, and if the electronic component is a radiation-responsive electronic component, the electronic component is responding to radiation. During the second time period, the electronic component is not emitting or responding to radiation.

In a specific embodiment, the field-effect transistor further includes a gate electrode and a gate dielectric layer. During the first and second time periods, the voltage on the gate electrode is substantially constant.

In a more specific embodiment, during the first time period, charge carriers are trapped within the gate dielectric layer. During the second time period, a substantial fraction of the charge carriers trapped within the gate dielectric layer during the first time period are de-trapped from the gate dielectric layer. In another more specific embodiment, a first voltage-time product is a first voltage difference between the gate electrode and the first/source drain region during the first time period times a length of the first time period. A second voltage-time product is a second voltage difference between the gate electrode and the first/source drain region during the second time period times a length of the first time period. The first voltage-time product and the second voltage time product are substantially equal.

In yet another embodiment, the second source/drain region or the second terminal of the electronic component is connected to a first terminal of a switch. The switch has second terminals. One of the second terminals of the switch provides the first signal to the second source/drain region. Another of the second terminals of the switch electrically floats.

In one embodiment, a method is used for operating an electronic device. The electronic device includes a field-effect transistor including a gate dielectric layer, a first source/drain region, and a second source/drain region. The first source/drain region is connected to a first terminal of an electronic component. The electronic component is a radiation-emitting electronic component or a radiation-responsive electronic component. The method includes, during a first time period, sending a first signal to one of a second terminal of the electronic component or a second source/drain region and sending a second signal to a gate electrode. The method also includes, during a second time period, sending a third signal to the second terminal of the electronic component or the second source/drain region, or both, wherein the third signal is different from the first signal and keeping the second signal on the gate electrode.

In another embodiment, during the first time period, if the electronic component is a radiation-emitting electronic component, the electronic component is emitting radiation, and if the electronic component is a radiation-responsive electronic component, the electronic component is responding to radiation. During the second time period, the electronic component is not emitting or responding to radiation.

In a more specific embodiment, the second source/drain region or the second terminal of the electronic component is connected to a first terminal of a switch. The switch has second terminals. One of the second terminals of the switch provides the first signal to the second source/drain region. Another of the second terminals of the switch provides the third signal to the second source/drain region.

In still another embodiment, during the first time period, charge carriers are trapped within the gate dielectric layer. During the second time period, a substantial fraction of the charge carriers trapped within the gate dielectric layer during the first time period are de-trapped from the gate dielectric layer.

In yet another embodiment, a first voltage-time product is a first voltage difference between the gate electrode and the first/source drain region during the first time period times a length of the first time period. A second voltage-time product is a second voltage difference between the gate electrode and the first/source drain region during the second time period times a length of the first time period. The first voltage-time product and the second voltage time product are substantially equal.

For any of the embodiments described above, the electronic component is an organic electronic component.

The detailed description first addresses Definitions and Clarification of Terms followed by Threshold Voltage and Trapped Charge, Exemplary Circuits, Methodology, Other Embodiments, and finally, Advantages.

1. Definitions and Clarification of Terms

Before addressing details of embodiments described below, some terms are defined or clarified. The term "active" when referring to a layer or material is intended to mean a layer or material that has electronic or electro-radiative properties. An active layer material may emit radiation or exhibit a change in concentration of electron-hole pairs when receiving radiation.

The term "amorphous silicon" ("a-Si") is intended to mean one or more layers of silicon having no discernible crystalline structure.

The terms "array," "peripheral circuitry," and "remote circuitry" are intended to mean different areas or components of an electronic device. For example, an array may include a number of pixels, cells, or other structures within an orderly arrangement (usually designated by columns and rows). The pixels, cells, or other structures within the array may be controlled locally by peripheral circuitry, which may lie on the same substrate as the array but outside the array itself. Remote circuitry typically lies away from the peripheral circuitry and can send signals to or receive signals from the array (typically via the peripheral circuitry). The remote circuitry may also perform functions unrelated to the array. The remote circuitry may or may not reside on the substrate having the array.

The term "capacitive electronic component" is intended to mean an electronic component configured to act as a capacitor when illustrated in a circuit diagram. Examples of capacitive electronic components include capacitor and transistor structures.

The term "charge carriers," with respect to an electronic component or circuit, is intended to mean the smallest unit of charge. Charge carriers can include n-type charge carriers (e.g., electrons or negatively charged ions), p-type charge carriers (e.g., holes or positively charged ions), or any combination thereof The term "channel region" is intended to mean a region lying between source/drain regions of a field-effect transistor, whose biasing, via a gate electrode of the field-effect transistor, affects the flow of carriers, or lack thereof, between the source/drain regions.

The term "circuit" is intended to mean a collection of electronic components that collectively, when properly connected and supplied with the proper potential(s), performs a function. A TFT driver circuit for an organic electronic component is an example of a circuit.

The term "connected," with respect to electronic components, circuits, or portions thereof, is intended to mean that two or more electronic components, circuits, or any combination of at least one electronic component and at least one circuit do not have any intervening electronic component lying between them. Parasitic resistance, parasitic capacitance, or both are not considered electronic components for the purposes of this definition. In one embodiment, electronic components are connected when they are electrically shorted to one another and lie at substantially the same voltage. Note that electronic components can be connected together using fiber optic lines to allow optical signals to be transmitted between such electronic components.

The term "continuous grain silicon ("CGS") is intended to mean a type of polysilicon in which individual crystals are oriented in a direction parallel to the channel length of a field-effect transistor. The oriented crystals reduce the frequency with which a charge encounters a grain boundary, resulting in an overall higher mobility of the channel region compared to a randomly oriented polysilicon channel.

The term "control line" is intended to mean a signal line having a primary function of transmitting one or more signals that control one or more electronic components, one or more circuits, or any combination thereof.

The term "control terminal" is intended to mean a terminal that is configured to receive a signal that controls at least a portion of one or more electronic component, circuit, or any combination thereof.

The term "coupled" is intended to mean a connection, linking, or association of two or more electronic components, circuits, systems, or any combination of at least two of: (1) at least one electronic component, (2) at least one circuit, or (3) at least one system in such a way that a signal (e.g., current, voltage, or optical signal) may be transferred from one to another. Non-limiting examples of "coupled" can include direct connections between electronic components, circuits or electronic components with switch(es) (e.g., transistor(s)) connected between them, or the like.

The term "data holder unit" is intended to mean an electronic component or a collection of electronic components configured to retain data on at least a temporary basis. An image holder unit is an example of a data holder unit, wherein the data corresponds to at least a portion of an image.

The term "data line" is intended to mean a signal line having a primary function of transmitting one or more signals that comprise information.

The term "de-trap," with respect to charge carriers, is intended to mean that the removal of at least one trapped charge carrier from within a layer, member, structure, or combination thereof, when an electrical field of a proper polarity and sufficient strength is applied to such layer, member, structure, or combination thereof for a sufficient length of time.

The term "electrical field" is intended to mean:

$$E = \frac{dV}{dx}$$

wherein:

E is the electrical field;

dV is a change in voltage; and dx is a change in distance.

The term "electrically float" or "float" is intended to mean that at least a portion of one or more component, circuit, or any combination thereof is not electrically connected to another one or more component, circuit, or any combination thereof or a power supply, or is part of an electrically open circuit.

The term "electronic component" is intended to mean a lowest level unit of a circuit that performs an electrical function. An electronic component may include a transistor, a diode, a resistor, a capacitor, an inductor, or the like. An electronic component does not include parasitic resistance (e.g., resistance of a wire) or parasitic capacitance (e.g., capacitive coupling between two conductors connected to different electronic components where a capacitor between the conductors is unintended or incidental).

The term "electronic device" is intended to mean a collection of circuits, organic electronic components, or combinations thereof that collectively, when properly connected and supplied with the proper voltage(s), performs a function. An electronic device may include or be part of a system. Examples of electronic devices include displays, sensor arrays, computer systems, avionics, automobiles, cellular phones, and many other consumer and industrial electronic products.

The term "field-effect transistor" is intended to mean a transistor, whose current carrying characteristics are affected by a voltage on a gate electrode. Field-effect transistors include junction field-effect transistors (JFETs) and metal-insulator-semiconductor field-effect transistors (MISFETs), including metal-oxide-semiconductor field-effect transistors (MOSFETs), metal-nitride-oxide-semiconductor (MNOS) field-effect transistors, and combinations thereof. A field-effect transistor can be n-channel (n-type carriers flowing within the channel region) or p-channel (p-type carriers flowing within the channel region). A field-effect transistor may be an enhancement-mode transistor (channel region having a different conductivity type compared to the source/drain regions) or depletion-mode transistor (channel and source/drain regions have the same conductivity type).

The term "low-temperature polysilicon" ("LTPS") is intended to mean one or more layers of polysilicon deposited at a temperature no greater than 550° C. One example of a process for forming LTPS is Sequential Lateral Solidification ("SLS"), in which a modified excimer laser crystallization ("ELC") process is used to form oriented grains of larger sizes, resulting in higher mobilities for charge carriers, when compared to conventional ELC techniques for forming LTPS.

The term "organic electronic device" is intended to mean a device including one or more organic semiconductor layers or materials. Organic electronic devices include: (1) devices that convert electrical energy into radiation (e.g., a light-emitting diode, light-emitting diode display, diode laser, or lighting panel), (2) devices that detect signals through electronic processes (e.g., photodetectors (e.g., photoconductive cells, photoresistors, photoswitches, phototransistors, phototubes), infrared ("IR") detectors, biosensors), (3) devices that convert radiation into electrical energy (e.g., a photovoltaic device or solar cell), and (4) devices that include one or more electronic components that include one or more organic semiconductor layers (e.g., a transistor or diode).

The term "polarity," when referring to a voltage is intended to mean that such voltage lies on one side of a reference voltage. Polarities are typically expressed as "+" or "−" with respect to the reference voltage.

The term "polysilicon" is intended to mean a layer of silicon made up of randomly oriented crystals.

The term "power supply line" is intended to mean a signal line having a primary function of transmitting power.

The term "radiation-emitting component" is intended to mean an electronic component, which when properly biased, emits radiation at a targeted wavelength or spectrum of wavelengths. The radiation may be within the visible-light spectrum or outside the visible-light spectrum (ultraviolet ("UV") or IR). A light-emitting diode is an example of a radiation-emitting component.

The term "radiation-responsive component" is intended to mean an electronic component, which when properly biased, can respond to radiation at a targeted wavelength or spectrum of wavelengths. The radiation may be within the visible-light spectrum or outside the visible-light spectrum (UV or IR). An IR sensor and a photovoltaic cell are examples of radiation-sensing components.

The term "recovering," with respect to an electronic component, electronic device, or any portion or combinations thereof, is intended to mean an act of returning an arrangement, characteristic, property, or any combination thereof of such electronic component, electronic device, or any portion or combination thereof at a later state closer to an arrangement, characteristic, property, or any combination thereof at a prior state.

The term "scan line" is intended to mean a select line whose activation occurs as a function of time.

The term "select line" is intended to mean a specific signal line within a set of signal lines having a primary function of transmitting one or more signals used to activate one or more electronic components, one or more circuits, or any combination thereof when the specific signal line is activated, wherein other electronic component(s), circuit(s), or any combination thereof associated with another signal line within the set of signal lines are not activated when the specific signal line is activated. The signals lines within the set of signal lines may or may not be activated as a function of time.

The term "select unit" is intended to mean one or more electronic components, one or more circuits, or a combination thereof controlled by a signal on a select line.

The term "signal" is intended to mean a current, a voltage, an optical signal, or any combination thereof. The signal can be a voltage or current from a power supply or can represent, by itself or in combination with other signal(s), data or other information. Optical signals can be based on pulses, intensity, or a combination thereof. Signals may be substantially constant (e.g., power supply voltages) or may vary over time (e.g., one voltage for on and another voltage for off).

The term "signal line" is intended to mean a line over which one or more signals may be transmitted. The signal to be transmitted may be substantially constant or vary. Signal lines can include control lines, data lines, scan lines, select lines, power supply lines, or any combination thereof. Note that signal lines may serve one or more principal functions.

The term "source/drain region" is intended to mean a region of a field-effect transistor that injects carriers into a channel region or receives carriers from the channel region. A source/drain region can include a source region or a drain region, depending on the flow of current through the field-effect transistor. A source/drain region may act as source region when current flows in one direction through the field-effect transistor, and as a drain region when current flows in the opposite direction through the field-effect transistor.

The term "state" is intended to mean a characteristic, condition, property, or a combination thereof of something (e.g., an electronic component, a circuit, a system, etc.) at a point in time or during a time period.

The term "switch" is intended to mean one or more electronic components configured to act as a switch when illustrated in a circuit diagram. Examples of switches include diode and transistor structures, mechanical (e.g., manual) switches, electro-mechanical switches (e.g., relays), etc. In one embodiment, a switch includes terminals through which can current flows and a control that can be used to allow or adjust current flowing through the switch or keep current from flowing through the switch.

The term "switch controller" is intended to mean one or more electronic components, one or more circuits, one or more software components (e.g., a software agent), or any combination thereof configured to control a switch.

The term "substantial fraction" is intended to mean a fraction of something causing a quantifiable or perceptible change such that a state of at least a portion of an electronic component, a circuit, a system, etc. has been changed. For example, a field-effect transistor has trapped charge carriers within its gate dielectric layer. By removing a substantial fraction of the charge carriers from the gate dielectric layer, the threshold voltage can be changed from a prior charged state to a more neutral current state.

The term "substantially equal" is intended to mean that two or more values of parameters are equal or almost equal such that any inequality is considered to be insignificant to one of ordinary skill in the art.

The term "trap" and its variants, with respect to charge carriers, is intended to mean that at least one charge carrier migrates into or resides within a layer, member, structure, or combination thereof, and other than removing all or part of such layer, member, structure, or combination thereof, such at least one charge carrier is not removed from such layer, member, structure, or combination thereof unless an electrical field of a proper polarity and sufficient strength is applied to such layer, member, structure, or combination thereof for a sufficient length of time.

The term "voltage-time product" is intended to a product of a voltage or voltage difference and the time period that such voltage or voltage difference is applied to an electronic component, a circuit or a portion thereof.

As used herein, the terms "comprises," "comprising," "includes," "including," "has," "having" or any other variation thereof, are intended to cover a non-exclusive inclusion. For example, a method, process, article, or apparatus that comprises a list of elements is not necessarily limited only those elements but may include other elements not expressly listed or inherent to such method, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of the "a" or "an" are employed to describe elements and components of the invention. This is done merely for convenience and to give a general sense of the invention. This description should be read to include one or at least one and the singular also includes the plural unless it is obvious that it is meant otherwise.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Group numbers corresponding to columns within the periodic table of the elements use the "New Notation" convention as seen in the CRC Handbook of Chemistry and Physics, 81st Edition (2000).

To the extent not described herein, many details regarding specific materials, processing acts, and circuits are conventional and may be found in textbooks and other sources within the organic light-emitting display, photodetector, semiconductor and microelectronic circuit arts. Details regarding radiation-emitting elements, pixels, subpixels, and pixel and subpixel circuitry will be addressed before turning to details of the radiation-sensing elements and circuitry.

2. Threshold Voltage and Trapped Charge

Embodiments of the present invention can allow for circuitry to address the problems associated with changing (i.e., drifting) threshold voltage for a field-effect transistor. The change in the threshold voltage can be due to trapped charges accumulating within the gate dielectric layer of the field-effect transistor. The equation below quantifies the relationship between threshold voltage and trapped charges.

$$\Delta V_{th}=q\cdot\Delta N_{trap}/C_{gd}$$

wherein, $\Delta V_{th}$ is the threshold voltage drift;

$\Delta N_{trap}$ is the number of trapped charges after gate biasing; and $C_{gd}$ is the capacitance of the gate dielectric layer.

The problems caused by trapped charges in the gate dielectric layer can occur with nearly any MISFET, but are more problematic when the source/drain regions and channel region of the MISFET are formed (e.g., deposited) as amorphous silicon (a-Si), low-temperature polysilicon (LTPS), continuous grain silicon (CGS), or any combination thereof.

Figure 4:
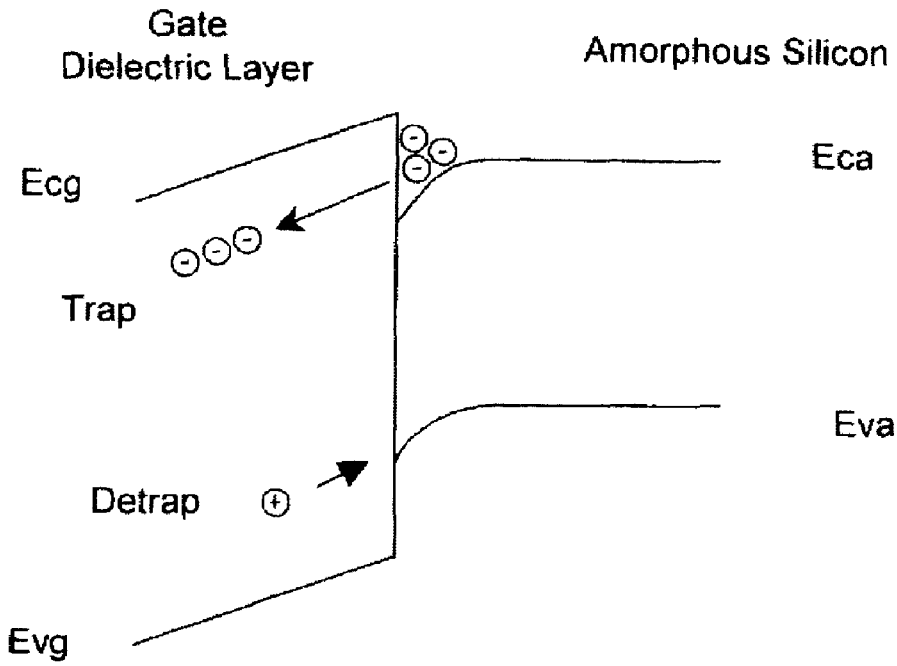
FIGS. 4 and 5 include band diagrams illustrating the trapping and de-trapping of charges within a gate dielectric layer.
Figure 5:
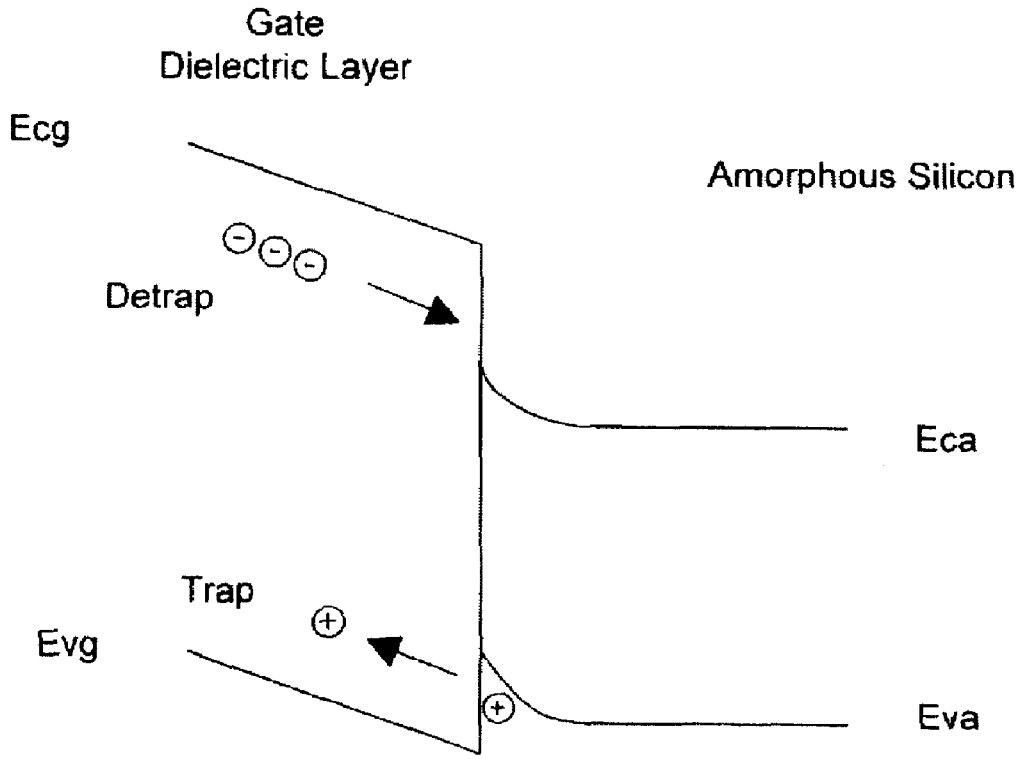

When a positive bias is placed on the gate electrode of a field-effect transistor as illustrated in FIG. 4, electrons are trapped within the gate dielectric layer, and holes are de-trapped from the gate dielectric layer. When a negative bias is placed on the gate electrode as illustrated in FIG. 5, electrons are de-trapped from the gate dielectric layer, and holes are trapped within the gate dielectric layer. As will be described in more detail below, circuits and structures can be used to reverse the affects of trapping too much charge within a gate dielectric layer.

3. Exemplary Circuits

Figure 6:
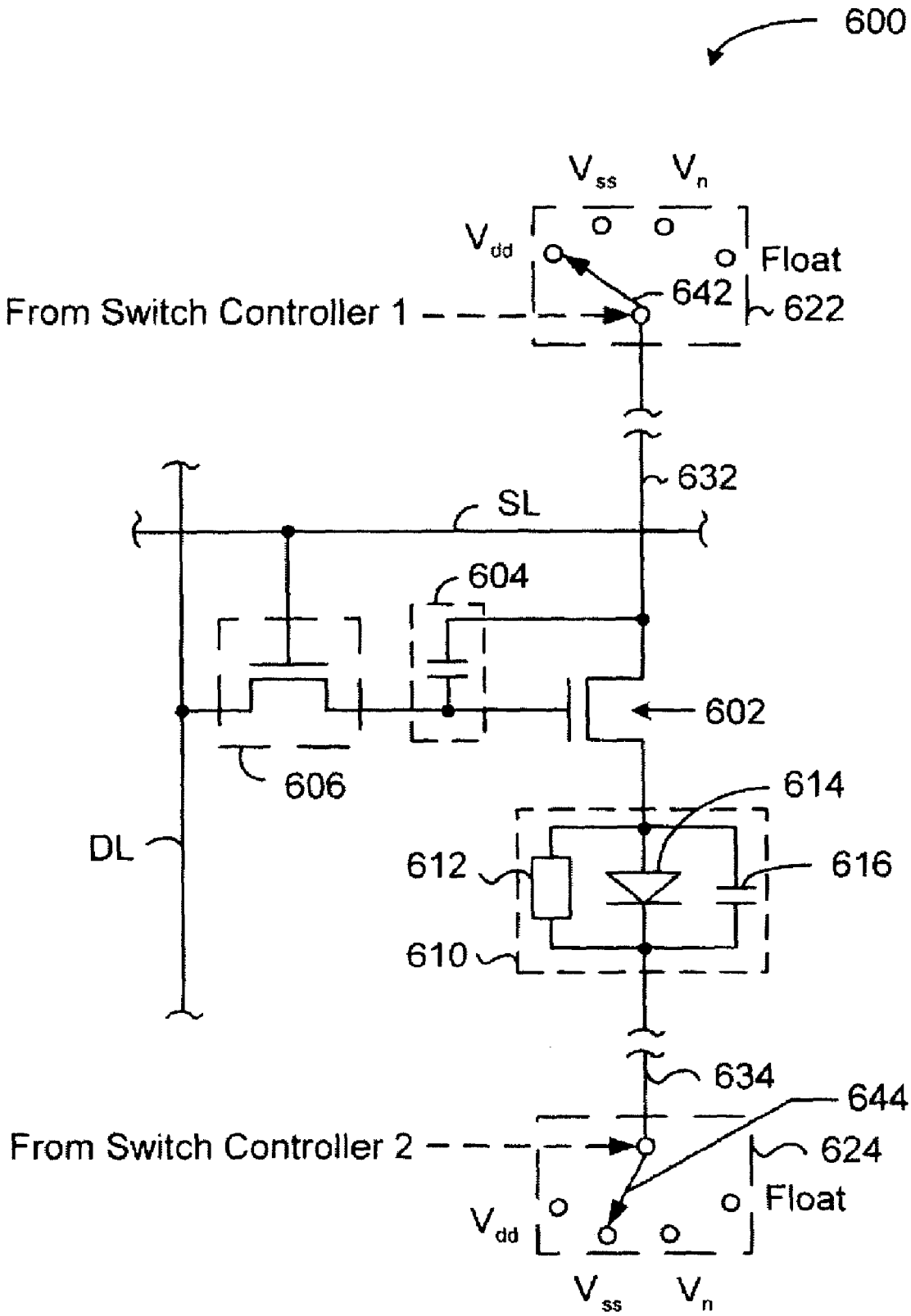
FIGS. 6-8 include circuit diagrams of electronic devices that include switchable power supply lines.

FIG. 6 illustrates a circuit diagram of an electronic device 600 comprising switches 622 and 624. As illustrated, switch 622 has a first terminal connected to signal line 632, and second terminals that can receive $V_{dd}$, $V_{ss}$, $V_n$, and another second terminal, a Float terminal, that electrically floats. Switch 624 has a first terminal connected to signal line 634, and second terminals that can receive $V_{dd}$, $V_{ss}$, $V_n$, and Float. In one embodiment, both switches 622 and 624 are coupled to a first electronic component 610.

$V_{dd}$ and $V_{ss}$ are a relatively positive power supply voltage and a relatively negative power supply voltage, respectively. The actual voltages of $V_{dd}$ and $V_{ss}$ may be positive, negative, zero, or any combination thereof. The voltage differential between $V_{dd}$ and $V_{ss}$ is typically more important than the actual values of $V_{dd}$ and $V_{ss}$, as electronic components may operate based on the voltage difference. In one embodiment, the voltage difference between $V_{dd}$ and $V_{ss}$ may be 10 volts. $V_n$ is a voltage other than $V_{dd}$ and $V_{ss}$. $V_n$ may be a constant voltage or vary (voltage may change on occasion or as a function of time). $V_n$ may be the same or different between the switches 622 and 624. $V_n$ is addressed in more detail later in this specification.

When Float is selected for switch 622 or 624, the signal line 632 or 634 is allowed to electrically float. In one embodiment, Float is not connected to anything outside the switch 622 or 624 (in a conduction path away from its first terminal) or is connected to an electrically open circuit (not shown). In another embodiment, a Float terminal may not be physically present; however, electrical floating may be achieved by positioning the switch 622 or 624, so that conductor 642 or 644 lies adjacent, but not connected, to any of the other physical terminals (e.g., between $V_{dd}$ and $V_{ss}$ or between $V_{ss}$ and $V_n$). For the purposes of this specification, positioning a switch (622 or 642) so that its conductor (642 or 644) lies adjacent, but not connected, to any of its other second terminals is considered selecting the Float terminal.

In one embodiment, each of the switches 622 and 624 lie outside the array and may have signals routed along signal lines 632 and 634, respectively, to pixels, and if present, sub-pixels, within an array. In another embodiment, any or all of the switches 622 and 624 may reside within the array and potentially within a pixel or sub-pixel. In other embodiments, the second terminals of the switches 622 and 624 are connected to more, fewer, or different signal lines, or any combination thereof.

Switch 622 is coupled to switch controller 1 (not shown), and switch 624 is coupled to switch controller 2 (not shown). In another embodiment, switches 622 and 624 are coupled to the same switch controller, such as switch controller 1 or switch controller 2. In still another embodiment, the switches 622 and 624 may be part of the same circuit, such as a double-pole, double-throw circuit. The switch controllers are conventional, and in one embodiment, are conventional D flip-flop circuits. The switch controllers may be coupled to the select line, SL, to activate the switches 622 and 624 when an activating signal is sent along SL.

Turning to other parts of the electronic device 600 in FIG. 6, a first field-effect transistor 602 includes a gate electrode, a gate dielectric layer, a first source/drain region, a second source/drain region, and a channel region lying between the first and second source/drain regions. In one embodiment, at least portions of the first and second source/drain regions and the channel region are formed (e.g., deposited) as amorphous silicon (a-Si), low-temperature polysilicon (LTPS), continuous grain silicon (CGS), or any combination thereof. In another embodiment, the first and second source/drain regions and the channel region include substantially monocrystalline silicon. In other embodiments, other Group 14 elements (e.g., carbon, germanium), by themselves or in combination (with or without silicon), may be used for the first and second source/drain regions and channel regions. In still other embodiments, the first and second source/drain regions and the channel region include III-V (Group 13-Group 15) semiconductors (e.g., GaAs, InP, GaAlAs, etc.), II-VI (Group 2-Group 16 or Group 12-Group 16) semiconductors (e.g., CdTe, CdSe, CdZnTe, ZnSe, ZnTe, etc.), or any combination thereof.

A first source/drain region of the first field-effect transistor 602 is connected to an anode of an electronic component 610. In one embodiment, the electronic component 610 is an organic, radiation-emitting electronic component, such as an OLED. While, in theory, the electronic component is a diode, for practical purposes, it can be treated as a resistive electronic component 612, a diode 614, and a capacitive electronic component 616, all connected in parallel as illustrated in FIG. 6. The significance of the parallel connection of the resistive electronic component 612, diode 614, and capacitive electronic component 616 is addressed later in this specification.

The data holder unit 604 has a first terminal and a second terminal. The first terminal of the data holder unit 604 is connected to the gate electrode of the first field-effect transistor 602 and the select unit 606. The second terminal of the data holder unit 604 is connected to the second source/drain region of the first field-effect transistor 602 and signal line 632. In one specific embodiment, the data holder unit 604 comprises a capacitive electronic component. A first electrode of the capacitive electronic component is connected to the gate electrode of the first field-effect transistor 602 and a second terminal of a select unit 606, and a second electrode of the capacitive electronic component is connected to the second source/drain region of the first field-effect transistor 602 and signal line 632. In an alternative embodiment (not shown), an optional anti-degradation unit may lie between the data holder unit 604 and signal line 632.

The select unit 606 has a first terminal connected to a data line ("DL"), a second terminal connected to the data holder unit 604 and the gate electrode of the first field-effect transistor 602, and a control terminal connected to a select line ("SL"). SL provides a control signal for select unit 606, and DL provides a data signal to be passed to the data holder unit 604 when the select unit 606 is activated. As illustrated in FIG. 6, the gate electrode of the first field-effect transistor 602 is coupled to DL via the select unit 606. In one embodiment, the select unit 606 includes a second field-effect transistor, wherein a first source/drain region is connected to DL, a second source/drain region is connected to the data holder unit 604, and a gate electrode is connected to SL. In another embodiment, the circuit for driving the electronic component 610 comprises no more than two transistors. In this embodiment, a transistor or other switch is not needed to place the second source/drain region and gate electrode of the field-effect transistor at substantially the same voltage. In other embodiments, other transistors (including JFETs and bipolar transistors), switches, or any combination thereof may be used within the select unit 606. In still other embodiments, more or different electronic component(s) can be used within the select unit 606.

In one embodiment, all of the select, switch, and data holder units and the first field-effect transistor 602 and electronic component 610 as illustrated in FIG. 6 may lie within the array. In another embodiment, any or all of the units may lie outside the array. For example, the switches 622 and 624 and corresponding switch controllers may lie outside the array (e.g., within peripheral circuitry) and the remainder of the units and components illustrated within FIG. 6 may lie within the array.

In still a further embodiment, only one of the switches 622 or 624 is used. If switch 622 is not present, the second source/drain region of the first field-effect transistor 602 and the second terminal of the data holder unit 624 are connected to a $V_{dd}$ line (i.e., signal line 632 is the $V_{dd}$ line). If switch 624 is not present, the cathode of the electronic component 610 is connected to a $V_{ss}$ line (i.e., signal line 634 is the $V_{ss}$ line).

Figure 7:
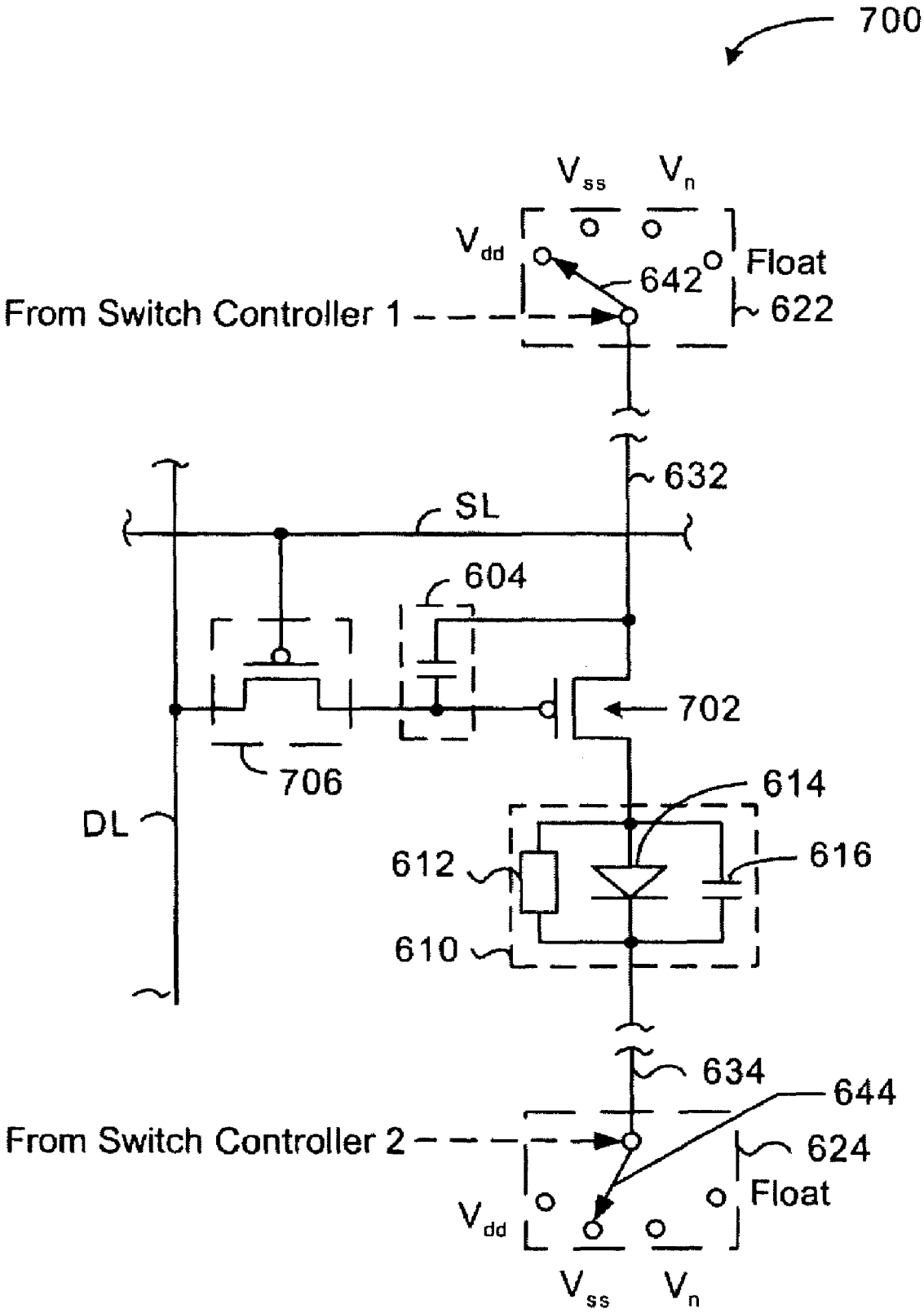
Figure 8:
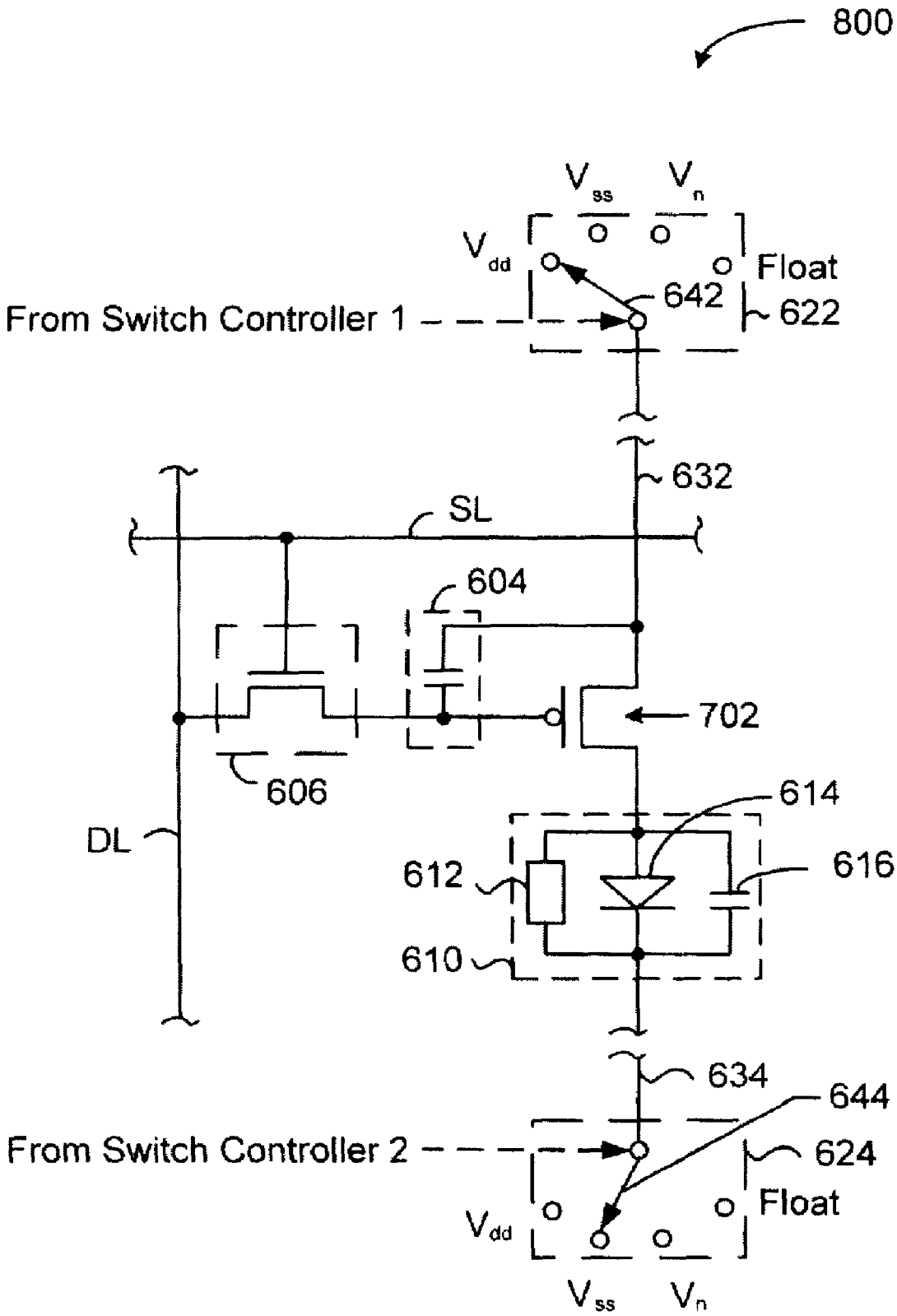

FIGS. 7 and 8 include illustrations where the first field-effect transistor 602, second field-effect transistor within the select unit 606 in FIG. 6, which are n-channel transistors, are replaced by one or more p-channel transistors. In FIG. 7, a third field-effect transistor 702 and a fourth field-effect transistor within a select unit 706 are p-channel field-effect transistors that replace the first and second field-effect transistors 602 and 606, respectively in FIG. 6. In FIG. 8, the third field-effect transistor 702 and the second field-effect transistor within select unit 606 are used. In another embodiment (not shown), the first field-effect transistor 602 and fourth field-effect transistor within the select unit 706 can be used. In any of the embodiments, the field-effect transistors can be enhancement-mode transistors, depletion-mode transistors, or any combination thereof. Some or all of the alternative embodiment described with respect to FIG. 6 also apply to FIGS. 7 and 8.

Figure 9:
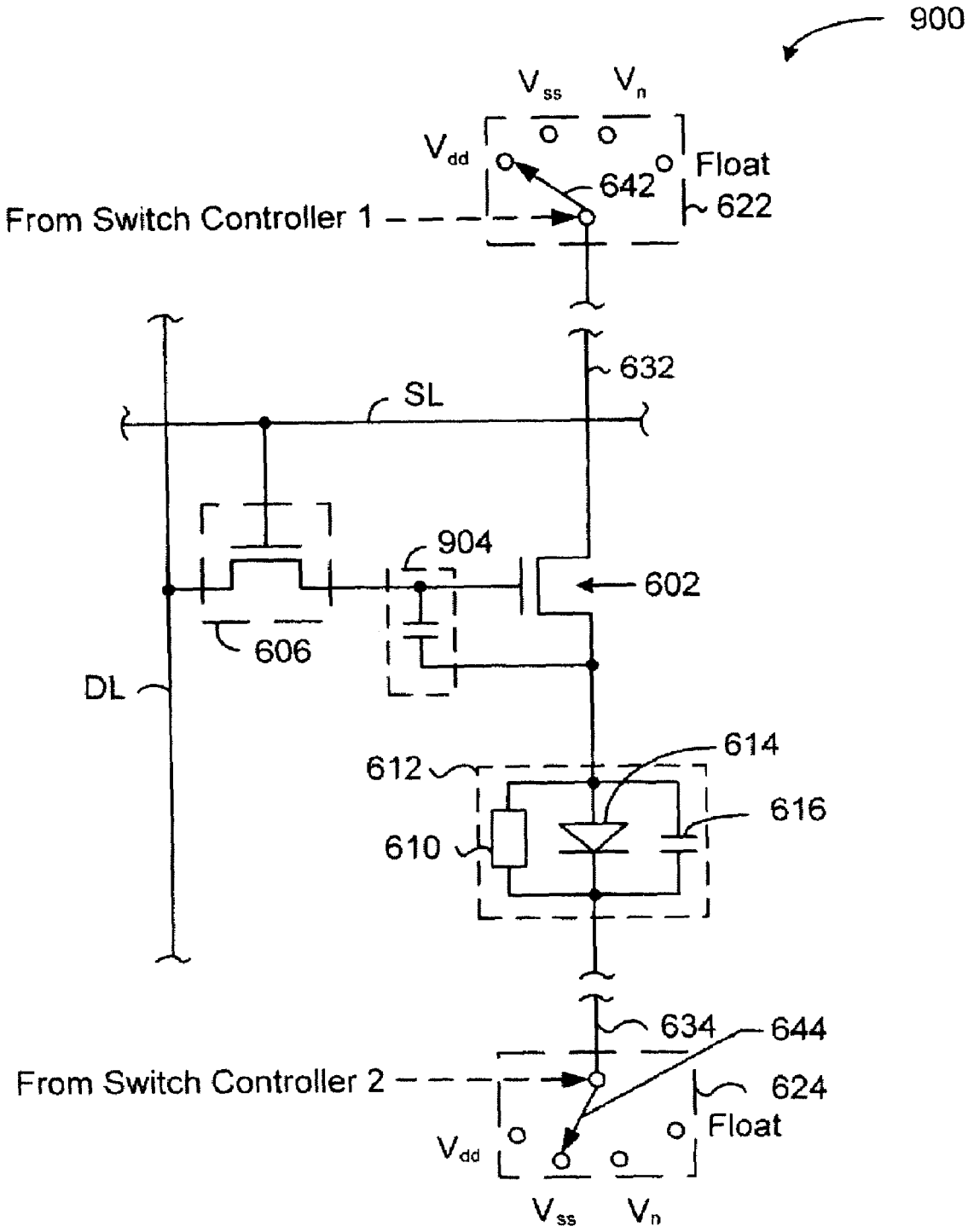
FIGS. 9 and 10 include circuit diagrams of electronic devices of alternate embodiments.
Figure 10:
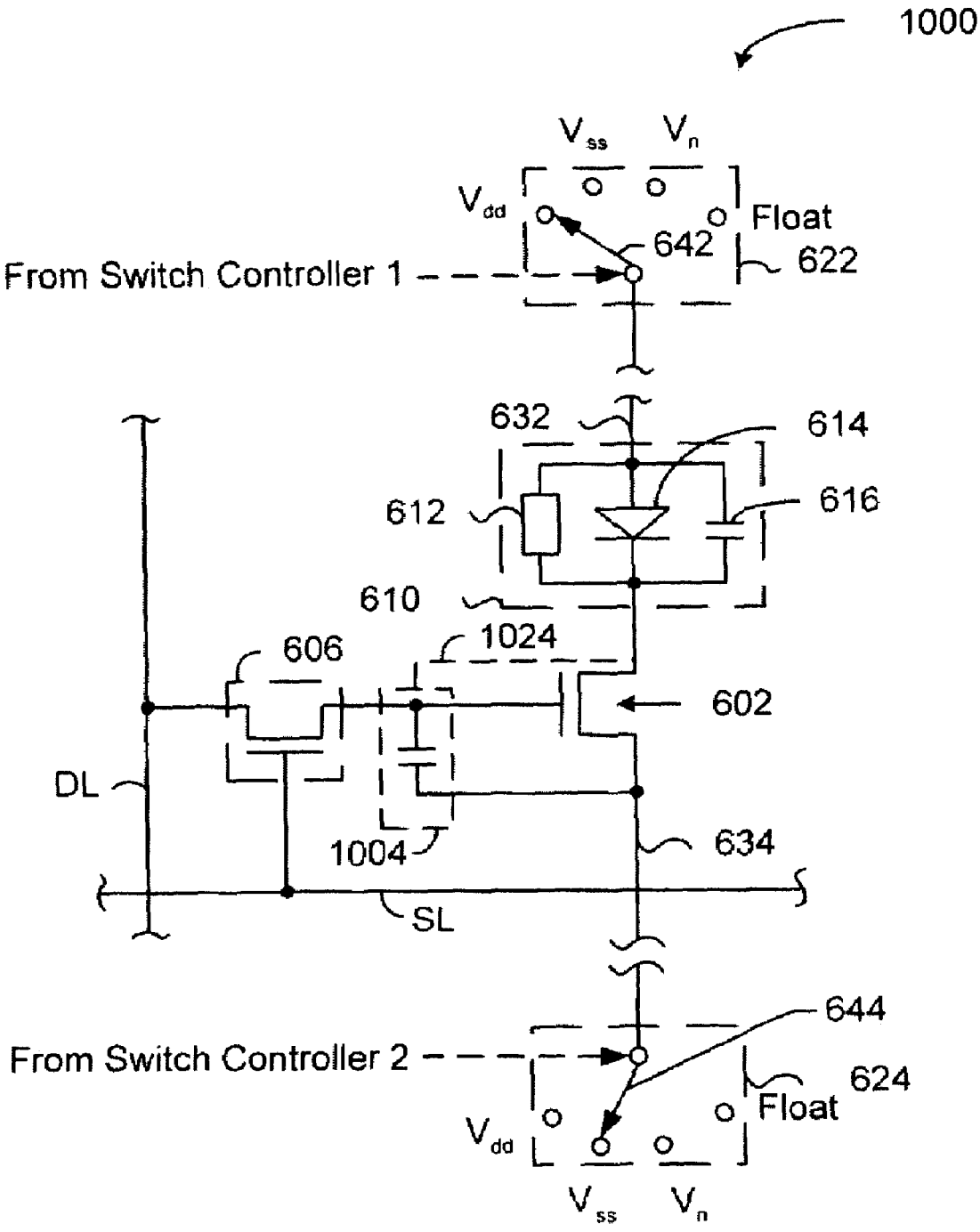

FIGS. 9 and 10 illustrate additional embodiments. In FIG. 9, the second terminal of the data holder unit 904 is connected to the first source/drain region of the first field-effect transistor 602, and the first terminal of the data holder unit 904 is connected to the gate electrode of the first field-effect transistor 602. In one specific embodiment, the data holder unit 904 includes a capacitive electronic component, wherein a first electrode of the capacitive electronic component is connected to the gate electrode of the first field-effect transistor 602 and the second terminal of the select unit 606, and a second electrode of the capacitive electronic component is connected to the first source/drain region of the first field-effect transistor and the anode of the electronic component 610.

In FIG. 10, the electronic component 610 and first field-effect transistor 602 are swapped with respect to the switches 622 and 624, relative to FIG. 9. The anode of the electronic component 610 is connected to the signal line 632, and the cathode of the electronic component 610 is connected to the first source/drain region of the first field-effect transistor 602. The second source/drain region of the first field-effect transistor 602 is connected to the signal line 634.

The first terminal of the data holder unit 1004 is connected to the gate electrode of the first field-effect transistor 602, and the second terminal of select unit 606. The second terminal of the data holder unit 1004 is coupled to the second source/drain region of the first field-effect transistor 602 and the signal line 634. In one specific embodiment, the data holder unit 1004 includes a capacitive electronic component, wherein a first electrode of the capacitive electronic component is connected to the gate electrode of the first field-effect transistor 602, and the second terminal of the select unit 606. The second electrode of the capacitive electronic component is coupled to the second source/drain region of the first field-effect transistor 602 and the signal line 634.

In still another embodiment (not shown), the data holder unit 1004 as illustrated in FIG. 10 may have its second terminal connected to the cathode of the electronic component 610 and the first source/drain region of the first field-effect transistor 602 (illustrated as dashed line 1024 in FIG. 10). In still further embodiments, any or all of the embodiments described in conjunction with FIGS. 6-8 are also applicable to embodiments described in conjunction with FIGS. 9 and 10.

In yet another embodiment, switch 622, switch 624, or both can be replaced by open-closed type switches. The first terminal of such open-closed type switch would be connected to the signal line 632 or 634. When the open-closed switch is in the open position, the switch is equivalent to switch 622 or 624 being set to the Float terminal. When closed, switch 622 connects the signal line 632 to a $V_{dd}$ line, and switch 624 connects the signal line 634 to a $V_{ss}$ line. Other circuitry (not shown) can provide the appropriate voltage to the second terminal of the open-closed switch.

4. Methodology

The circuits and systems previously described can be used to help recover threshold voltages of a field-effect transistor to a prior state. In one embodiment the method can be used to return the threshold voltage of the power field-effect transistor to its original state. Much of the following discussion will focus on the circuit diagram as illustrated in FIG. 6. However after reading this specification, skilled artisans will be able to use the concepts described herein for other circuits and systems, such as the ones illustrated and described in FIGS. 7 through 10. While the methodology will be described with respect to radiation-emitting electronic components, the concepts described herein may be extended to other types of electronic devices, some of which may include radiation-responsive electronic devices.

Figure 11:
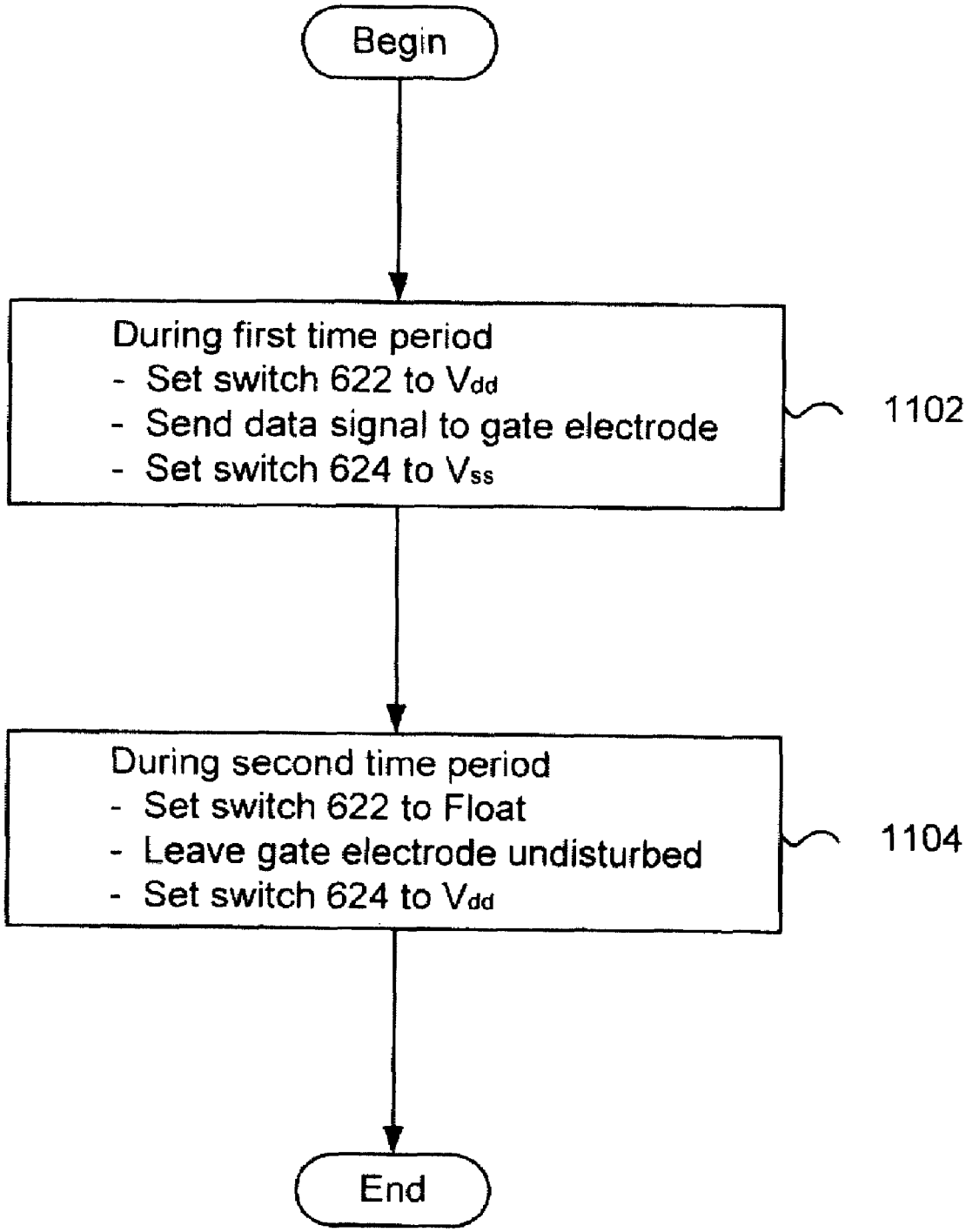
FIGS. 11 and 12 include flow charts for an operating electronic device including a circuit as described herein.

FIG. 11 includes a flow chart for using an electronic device 600 that includes the switches 622 and 624. A first time period 1102 corresponds to a time period in which the electronic device 600 is operating in its normal operating mode. In one embodiment, if the electronic component 610 is a radiation-emitting electronic component, the electronic component 610 emits radiation in the normal operating mode. In another embodiment, if the electronic component 610 is a radiation-responsive electronic component, the electronic component 610 responds to radiation in the normal operating mode.

During the first time period 1102, switch 622 is set to the $V_{dd}$ terminal ($V_{dd}$ signal sent to the second source/drain region of the first field-effect transistor 602), switch 624 is set to the $V_{ss}$ terminal ($V_{ss}$ signal sent to the second terminal of the electronic component 610), and data corresponding to an image to be displayed is sent along DL which in turn will be transmitted to the gate electrode of field-effect transistor 602. While the first field-effect transistor 602 is on, charge carriers can become trapped within its gate dielectric layer. The voltage difference between the gate electrode and the first source/drain region (which is connected to the first terminal, e.g., the anode, of electronic component 610) causes electrons to be trapped within the gate dielectric layer. The voltage difference between the gate electrode and the second source/drain region (which is connected to the switch 622) may cause holes or electrons to be trapped within the gate dielectric layer depending on the voltage differential between the two. In one embodiment, electrons trapped within the gate dielectric layer near the first source/drain region of field-effect transistor 602 can cause the threshold voltage of the first field-effect transistor 602 to become more positive, which is undesired.

To return the threshold voltage closer to its original or other prior state, a recovery operation is performed during a second time period 1104. During the second time period, the electronic component 610 is not operating in its normal operating mode, and therefore, is not emitting or responding to radiation.

In one embodiment, the switch 622 is set to the Float terminal, the switch 624 is set to the $V_{dd}$ terminal ($V_{dd}$ signal sent to the second terminal of the electronic component 610), and the signal on the gate electrode of the first field-effect transistor 602 is kept at the substantially same voltage as during the first time period 1102 (i.e., remains undisturbed) due to the signal being retained by the data holder unit 604. When the switch 622 is set to the Float terminal, the second source/drain region of field-effect transistor 602 is allowed to electrically float. Because the second source/drain region is allowed to electrically float, no significant current flows between the first and second source/drain regions of field-effect transistor 602. Therefore, the current flow during the recovery operation is significantly lower than if the second source/drain region of the first field-effect transistor 602 were connected to another terminal that is at a voltage different from the first source/drain region.

When the switch 624 is set to the $V_{dd}$ terminal, the electronic component 610 may be reversed biased. The electronic component 610 includes resistive electronic component 612. The resistive electronic component 612 allows the voltage on the first source/drain region of the first field-effect transistor 602 to become higher, and potentially higher than the voltage on the gate electrode of field-effect transistor 602. After the voltage of the first source/drain region is higher than the voltage on the gate electrode, electrons can be de-trapped from the gate dielectric layer of field-effect transistor 602. After electrons are de-trapped from the gate dielectric layer, the threshold voltage of the first field-effect transistor 602 is lowered. In one embodiment, a first voltage-time product of the voltage difference between the gate electrode and the first source/drain region of the first field-effect transistor 602 times the length of the first time period 1102 is substantially equal to a second voltage-time product of the voltage difference between the gate electrode and the first source/drain region of the first field-effect transistor 602 times the length of the second time period 1104. In another embodiment, a substantial fraction of the charge carriers (e.g., electrons) that became trapped in the gate dielectric layer during the first time period 1102 are de-trapped during the second time period 1104.

In another embodiment, the n-channel field-effect transistor 602 may be replaced by a p-channel field-effect transistor, such as the field-effect transistor 702 in FIG. 7. In this embodiment, while the field-effect transistor 702 is on, charge carriers can be trapped within its gate dielectric layer. The voltage difference between the gate electrode and the second source/drain region (which is connected to the switch 622) can cause holes to be trapped within the gate dielectric layer. To return the threshold voltage closer to its original or prior state, a recovery operation can be performed during the second time period 1104. In one embodiment, the switch 622 is set to the $V_n$ terminal ($V_n$ signal sent to the second source/drain region of the first field-effect transistor 602), the switch 624 is set to the Float terminal (first source/drain region of the first field-effect transistor 602 electrically floats), and the signal on the gate electrode of the field-effect transistor 702 is kept at the same voltage as during the first time period 1102 (i.e., remains undisturbed). In this embodiment, $V_n$ may be a negative voltage with respect to $V_{ss}$, ground, or another voltage. When the voltage on the second source/drain region of field-effect transistor 702 is less than the voltage on the gate electrode of field-effect transistor 702, holes can be de-trapped from the gate dielectric layer. After the holes are de-trapped, the threshold voltage of the field-effect transistor 702 increases and may return closer to its state prior to the first time period 1102 or when the transistor 702 was originally fabricated.

Figure 12:
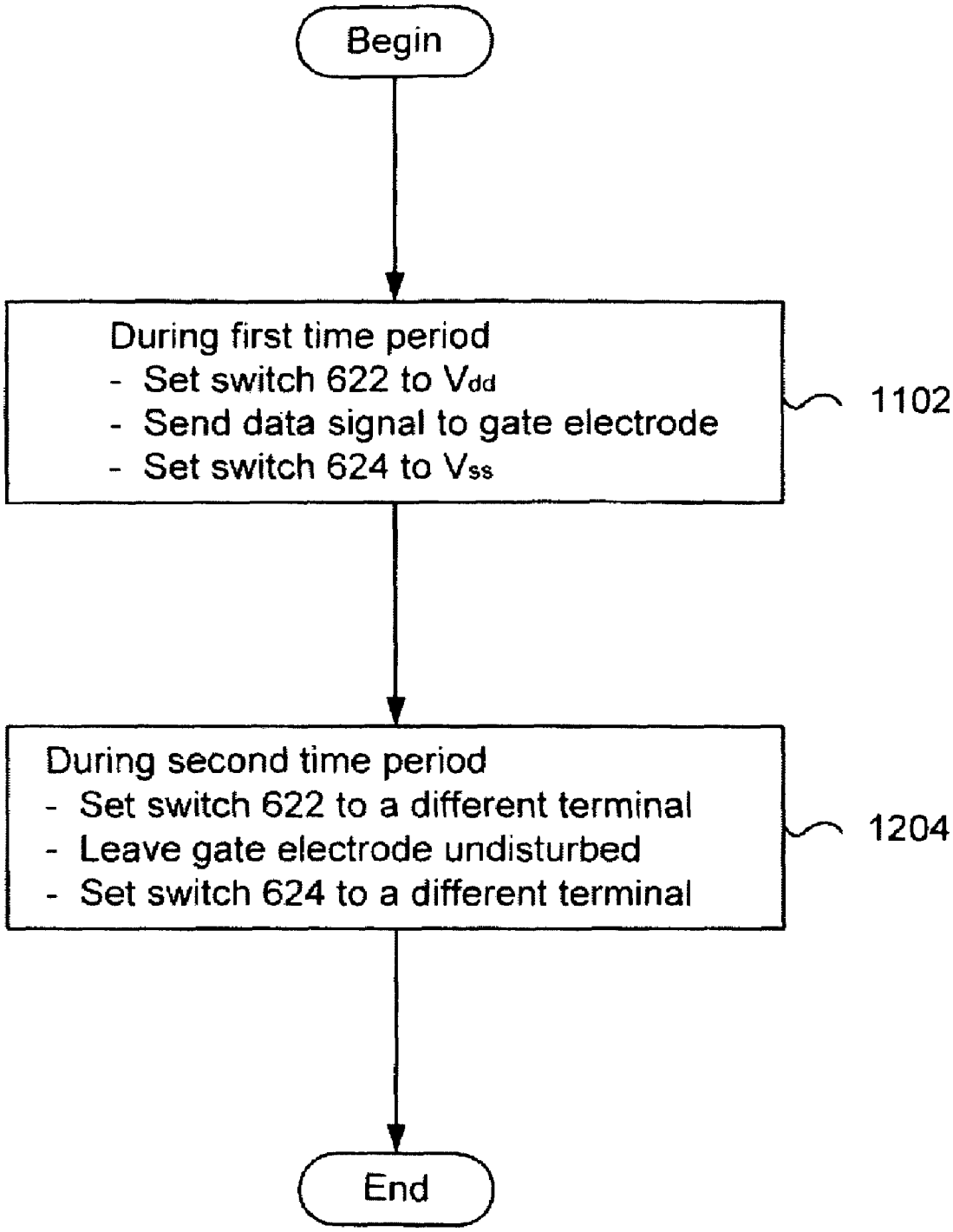

In still another embodiment, both switches 622 and 624 can be switched between the first and second time periods 1102 and 1204 as illustrated in FIG. 12. Reference will again be made to FIG. 6 to simplify understanding of the operation of the electronic device 600 during the second time period 1204. In one embodiment, switches 622 and 624 may be set to the $V_n$ terminals during the second time period. In this particular embodiment, $V_n$ may have a voltage higher than $V_{dd}$, the maximum allowed voltage on the gate electrode (as determined by emission intensity specifications), or both. The higher voltage may allow the length of the second time period 1204 to be potentially shorter than the length of the first time period 1102. In this manner, substantially equal voltage-time products for the first and second time periods 1102 and 1204 may still be achieved and allow a substantial fraction of charge carriers, which became trapped during the first time period 1102, to be de-trapped from the gate dielectric layer of the first field-effect transistor 602 during the second time period 1204. In another embodiment, both switches 622 and 624 can be switched so that during the second time period 1204, the switches 622 and 624 are set to different terminals compared to each other.

Figure 13:
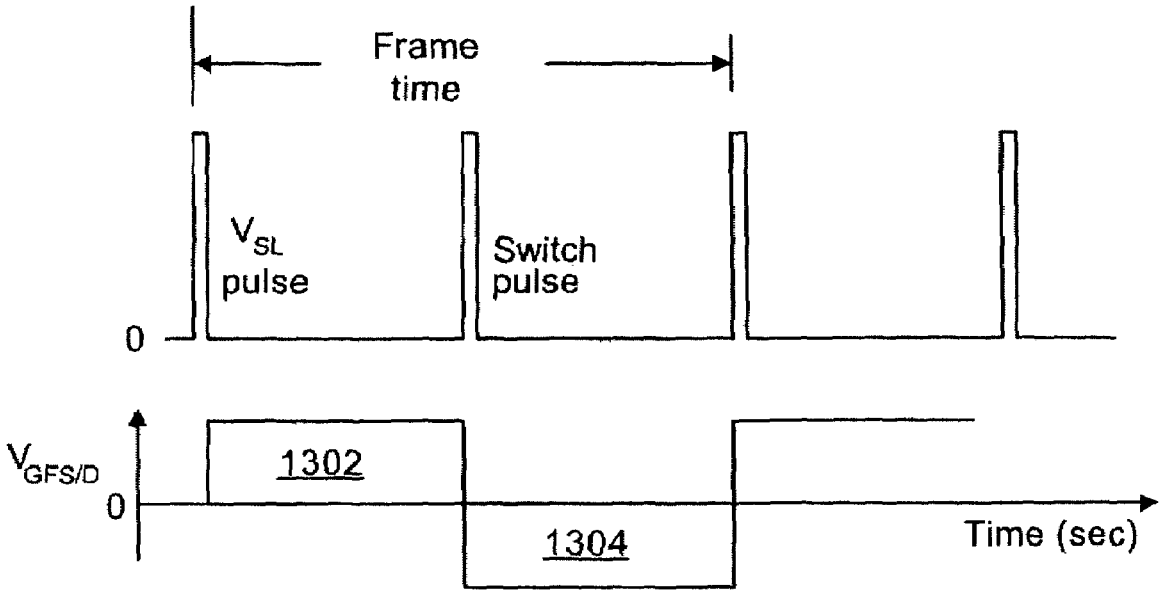
FIG. 13 includes a timing diagram for using the embodiment as illustrated in FIG. 6 in accordance with one embodiment.

FIG. 13 includes a timing diagram of signals and the voltage difference between the gate electrode and first source/drain region of the first field-effect transistor 602 in FIG. 6. In one embodiment, a frame time (e.g., 1/60 second)

can be divided into a first time period and a second time period having substantially equal lengths. Switches 622 and 624 are set to the $V_{dd}$ and $V_{ss}$ terminals, respectively. During a pulse on SL, $V_{SL}$, the select unit 606 turns on and transmits a data signal on DL to the gate electrode of the first field-effect transistor 602, wherein the data signal can correspond to an image to be displayed. The voltage difference between the gate electrode and the first/source drain region of the first field-effect transistor 602, $V_{GFS/D}$, is also illustrated in FIG. 13. The voltage-time product for $V_{GFS/D}$ during the first time period is illustrated by area 1302. The amount of charge carriers trapped within the gate dielectric layer of field-effect transistor 602 is a function of voltage-time product.

During a second time period within the frame time, a signal from switch controller 2 changes the setting on switch 624 to the $V_n$ terminal. In one embodiment, the switch 622 may be kept at $V_{dd}$ or changed to another terminal, such as $V_n$ or Float. In one embodiment, a signal is not sent to the select unit 606, and therefore, the data holder unit 604 keeps the gate electrode of the first field-effect transistor 602 at substantially the same voltage. The polarity of $V_{GFS/D}$ is reversed. The voltage-time product for $V_{GFS/D}$ during the second time period is illustrated by area 1304. In one embodiment, area 1302 is substantially equal to area 1304, and a substantial fraction of trapped charge carriers within the gate dielectric layer of field-effect transistor 602 are de-trapped during the second time period.

In one specific embodiment, during the first time period, the electronic component 610 has a 0.5 volt drop when forward biased and $V_{ss}$=0 volts, and a 2.0 volt drop when reverse biased. In this specific embodiment, the signal on the gate electrode is +6.5 volts, and therefore, $V_{GFS/D}$ is +6.0 volts during the first time period. During the second time period, the polarity of the $V_{GFS/D}$ is reversed and is −6.0 volts. Therefore, the voltage on the first source/drain region of the first field-effect transistor 602 will be +12.5 volts. To account for the 2.0 volt potential drop through the electronic component 610 during the second time period, $V_n$ may be set to +14.5 volts during the second time frame. After reading this specification, skilled artisans will be able to determine appropriate voltages for the use during the second time period.

In still another embodiment, the electronic device comprises a display including an array of electronic components 610 and corresponding driver circuits each including the first field-effect transistor 602, data holder unit 604, and select unit 606. In one embodiment, SL may be shared by other electronic components, similar to electronic component 610, along the same row as electronic component 610, and DL may be shared by other electronic components, similar to electronic component 610, along the same column as electronic component 610. In another embodiment, the orientation of rows and columns can be reversed. Switch controllers and switches 622 and 624 may lie near the edge of the array and may be located within the array or within peripheral circuitry (outside the array).

In another embodiment, the frame time can be separated into three time periods: a first time period used in a normal operating mode (e.g., as a display), a second time period for removing one type of trapped carriers from the gate dielectric layer near the first source/drain region of the first field-effect transistor 602, and a third time period for removing a different type of trapped carriers from the gate dielectric layer near the second source/drain region of the first field-effect transistor 602. In one specific embodiment, the amount of trapped charged carriers near the second source/drain region of the first field-effect transistor 602 is substantially less than the amount of trapped charged carriers near the first source/drain region. In this embodiment, the third time period may be shorter than the first time period, the second time period, or both, and may or may not use a relatively smaller voltage difference between the gate electrode and the second source/drain region of the first field-effect transistor 602.

In one embodiment, during the first time period, the gate electrode is at 6.0 volts, and the voltage of the second source/drain region of the first field-effect transistor 602 is 9.0 volts. During the second time period, the second source/drain region electrically floats because the switch 622 is set to the Float terminal. During the third time period, which in this embodiment may be only half as long as the first time period, the voltage of the second source/drain voltage is set to 0 volts. Charge carriers (e.g., holes) that became trapped within the gate dielectric layer during the first time period may be de-trapped during the third time period. The voltages used can depend on the actual length of the time period.

In still another embodiment, the voltage-time products for any particular first time period does not have to equal the voltage-time product of any other of the second or third time period during the same frame time. The accumulation of charge carriers within gate dielectric layer is substantially proportional to the product of the electrical field across the gate dielectric layer and the time such electrical field is applied. Over a relatively long period of time (e.g., several frame times), the cumulative trapped charge within the gate dielectric layer should be relatively low. Therefore, an averaged voltage (e.g., time-weighted average) on the gate electrode during radiation emission for any one or more electronic components may be used for determining a value for the voltage applied to the first source/drain region, second source/drain region, or both during de-trapping operations.

In yet another embodiment, constant, rarely or infrequently changing voltage(s) may be used during de-trapping. In a further embodiment, the voltage(s) may be changed during or after each frame time or predetermined number of frame times. In yet a further embodiment, the voltage(s) used during de-trapping may be a time-varying signal (e.g., alternating current, exponential or asymptotic increase or decrease, or any combination thereof).

In another embodiment, a table comprising entries can be used to store voltage-time products for each of the electronic components within the array. The table can be as simple as a set of capacitors, or may include a set of memory cells (dynamic random access memory, static random access memory, non-volatile memory), a portion of a hard drive, or any combination thereof.

The values stored in the table can include the voltages of the data signals, voltage differences between the data signals and any of the first source/drain region, second source/drain region, or any of the terminals of switches 622 or 624, wherein such terminals are connected to a signal line, or can be a function of such voltages or voltage differences. In one embodiment, the voltages of the data signals are stored, in another embodiment, $V_{GFS/D}$ is stored, in still another embodiment, the voltage-time products are either the voltages of the data signals or $V_{GFSD}$ times the length of the first time period. In still further embodiments, voltages for the second time period, lengths of the second time period, or any combination thereof may be values stored within the table.

In one embodiment, a conventional integrator can be used to determine the voltage-time products during the first time period. Other methods or equipment (e.g., a microprocessor or microcontroller) may be used for determining voltage-time products.

In another embodiment, values of signals to use during the second time period may be calculated or otherwise determined using the entries within the table. In another embodiment, the values of the signals to be used during the second time period may be stored, and therefore, before the second time period, the values are accessed from entries within the table.

In yet another embodiment, the table may include voltage-time products for each of the electronic components while the electronic device is operating, which corresponds to a first time period. After the electronic device is no longer operating in its normal operating mode, a recovery operation can be performed to de-trap trapped charge carriers during a second time period having a pre-determined length. The voltage-time products are divided by the length of the second time period and appropriate signals are used to de-trap at least some of the trapped charge carriers. After the second time period expires, an optional third time period for other types of charge carriers can be used, or the electronic device may return to a normal operating mode, go into a standby mode, shutdown, or other state.

Figure 14:
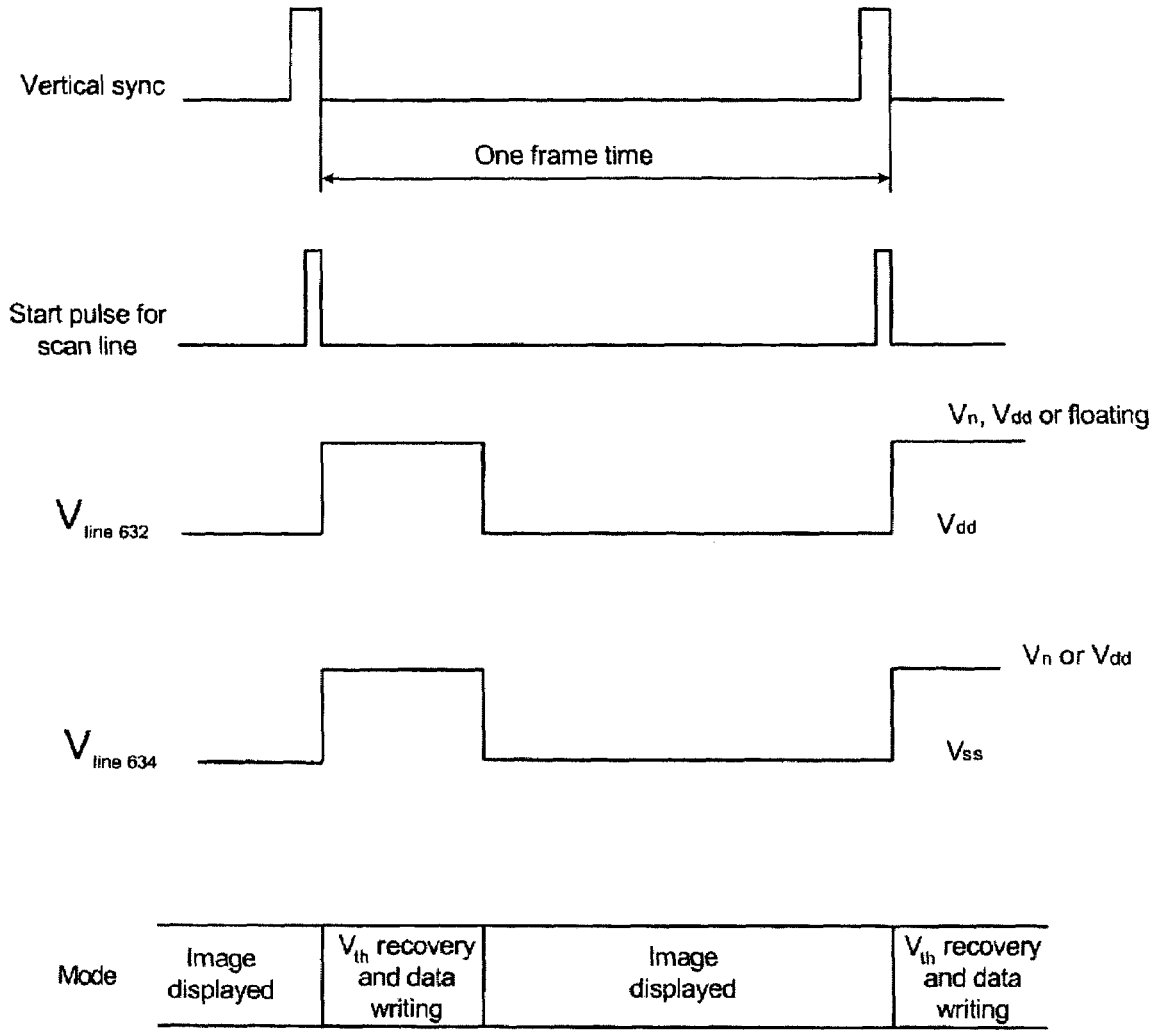
FIG. 14 includes a timing diagram for using the embodiment as illustrated in FIG. 6 in accordance with another embodiment.

FIG. 14 includes a further embodiment which can be used to reverse drifting of the threshold voltage when data for an image is being written into the data holder units within the pixels. Time lines of several signals and actions are illustrated to give a better understanding of the sequence of actions that occur. A vertical sync signal activates the start pulse (signal) so that the scan lines within an array will be sequentially activated.

While data is being written into the data holder units (such as data holder unit 604 in FIG. 6), one or both of the switches 622 and 624 can be set to the $V_{dd}$, $V_n$ or Float terminal in this embodiment. In one specific embodiment, the switches 622 and 624 are set to the same terminal, such as $V_{dd}$, to reduce current flow through the channel of the first field-effect transistor. The voltage on signal lines 632 and 634 will be substantially the same potential to which the terminals of the switches 622 and 624, respectively, are set. The signal from the switch controllers 1 and 2 may be activated when the first scan line (e.g., first row of the array) is activated and deactivated when the last scan line (e.g., last row of the array) is activated. During this time period, trapped charges within the gate dielectric layer of the first field-effect transistor 602 are removed.

After the image has been written (capacitors within the data holder units 604 charged to the proper potential), the switches 622 and 624 are set to the $V_{dd}$ and $V_{ss}$ terminals, respectively, and therefore, the voltage on signal lines 632 and 634 will be substantially $V_{dd}$ and $V_{ss}$, respectively. The electronic device is in the normal display mode during this time period, and the image is displayed to the user during this time period. Charges may become trapped within the gate dielectric of the first field-effect transistor 602 during this time. The time period can end when the first scan line is activated.

After reading this specification, skilled artisans appreciate that the exact timing of the start and end of the time periods for threshold voltage recovery and image display are not critical. In one embodiment, the time for starting the threshold voltage recovery may occur when the vertical sync pulse or start pulse for scan lines occur.

Figure 15:
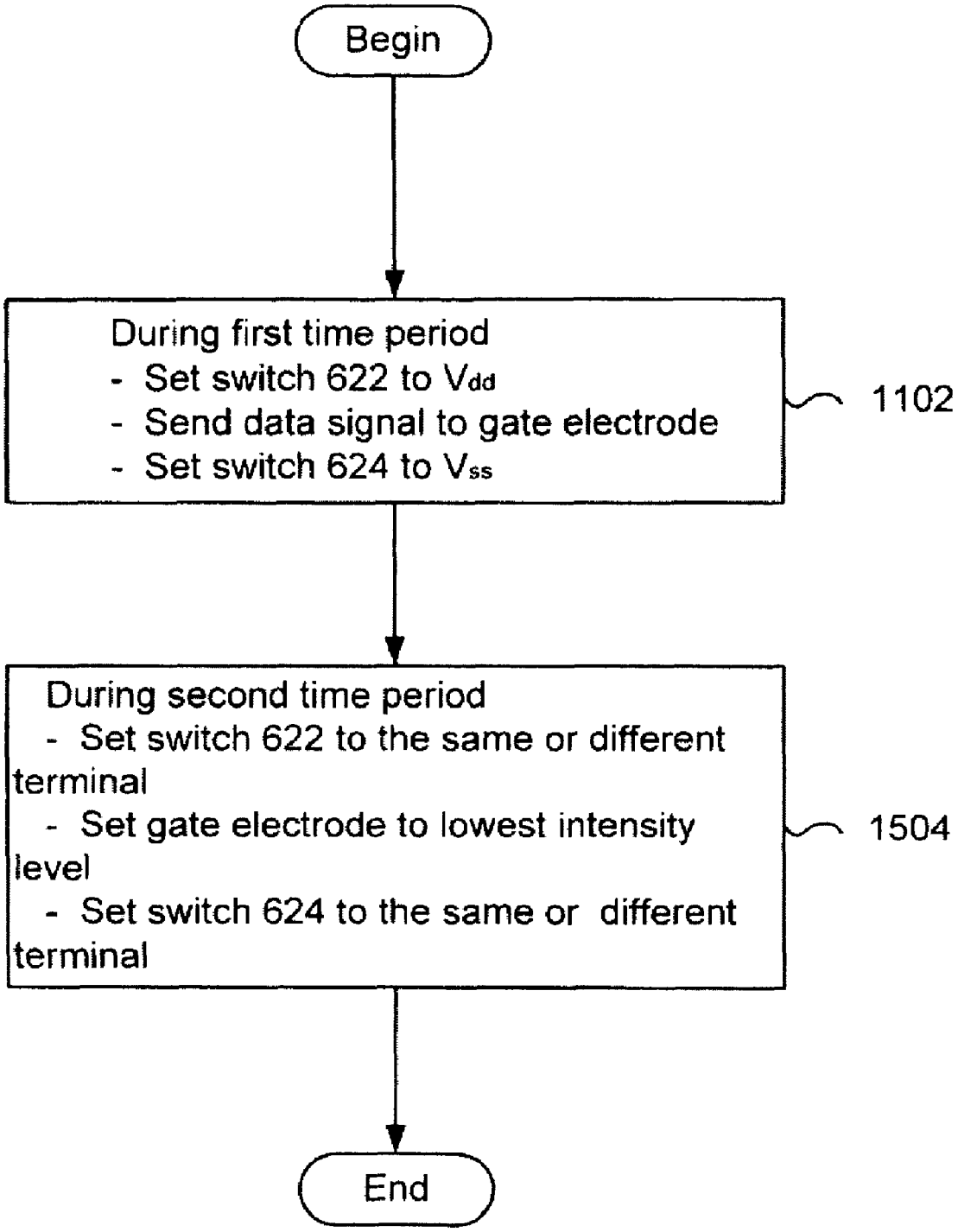
FIG. 15 includes a flow chart for an operating electronic device including a circuit as described herein.

FIG. 15 includes another embodiment in which threshold voltage recovery may occur after use of a display for an electronic device has finished but before the electronic device is fully powered down. A first time period 1102 corresponds to a time period in which the electronic device 600 is operating in its normal operating mode as previously described with respect to FIG. 11. During this time, information regarding the display may be stored in a table or within other memory. The information regarding the display can include the time that the display was on (i.e., length of the first time period), voltages on one or all of the gate electrodes for the first field-effect transistors, an averaged voltage (average, geometric mean, median, etc.) for some or all of the gate electrodes for the first field-effect transistors 602, or the like.

After use of the display has been terminated, the electronic device can go into a standby mode, start a shut-down sequence, or the like. During this second time period 1504, the data lines may be taken to the lowest intensity (e.g., data value of 0000 or the like), and the scan lines can be activated to place the gate electrodes of the first field-effect transistors at the corresponding voltage, which is slightly higher than the threshold voltage of the first field-effect transistors 602, as fabricated. The switch 622, 624, or both may be set to the same or different terminal. In one embodiment, the switches 622 and 624 are set to $V_{dd}$. In another embodiment, the switches 622 and 624 are set to $V_{ss}$. In still another embodiment, the switches 622 and 624 are set to $V_n$. In yet a further embodiment, one of the switches 622 and 624 is set to $V_{dd}$ or $V_n$, and the other of the switches 622 and 624 is set to Float. Still other combinations are possible. The switches 622 and 624 are set to their respective terminals to allow trapped charges within the gate dielectric layers of the first field-effect transistors 602 to be removed. In one embodiment, the voltage-time product(s) from the first time period is substantially the same as the voltage-time product(s) from the second time period. In this embodiment, the length of the second time period is a function of the first voltage-time product(s) and the voltage(s) used during the second time period.

Although not shown in FIG. 15, an optional third time period can be used similar to the second time period in another embodiment. During the second time period, the switch 622 is set to Float, and the switch 624 is set to $V_{dd}$ or $V_n$ to remove trapped electrons from the gate dielectric layer of the first field-effect transistors 602. During the third time period, the switch 622 is set to $V_{ss}$ or $V_n$ and the switch 624 set to Float to remove trapped holes from the gate dielectric layer of the first field-effect transistors 602.

After the threshold voltage recovery operation is completed, the shut-down sequence can be continued, and the electronic device can be taken to a standby, hibernate, shutdown, or other inactive state.

Many other types of data and method can be used. After reading this specification, skilled artisans understand that the exact type and implementation of table(s) is highly varied and can be tailored to fits the needs and desires for a specific application.

5. Other Embodiments

The embodiments described above are well suited for AMOLED displays. Still, the concepts described herein can be used for other types of radiation-emitting electronic components. Other radiation-emitting electronic components can include light bulbs, inorganic LEDs, including III-V or II-VI-based inorganic radiation-emitting components. In one embodiment, the radiation-emitting electronic components may emit radiation within the visible light spectrum, and in another embodiment, the radiation-emitting electronic component may emit radiation outside the visible light spectrum (e.g., UV or IR).

In another embodiment, the concepts described herein may be extended to other types of electronic devices. In one embodiment, a sensor array may include an array of radiation-responsive electronic components. In one embodiment, different radiation-responsive electronic components may have the same or different active materials. The response of those active materials may change over time. Further some of the sensor array may have different portions that receive different wavelengths, different radiation intensities, or a combination thereof. Similar to an electronic device with radiation-emitting electronic components, the lifetime of an electronic device with radiation-responsive electronic components may have a longer useful life.

6. Advantages

One or more embodiments described herein can be used to help to recover threshold voltages of field-effect transistors used in driver circuits closer to an original or prior state. In one embodiment, the driver circuit for each electronic component can be conventional and does not need to be changed. Therefore, 2T-1C driver circuits can be used. A third transistor is not required for putting the second source/drain region and the gate electrode of the power field-effect transistor at substantially the same voltage. With less electronic components within the driver circuit, less area need to be dedicated to the driver circuits, and therefore, the display or sensing area for radiation-emitting or radiation-responsive electronic component can be larger.

In one embodiment, switches including switches 622 and 624 and their corresponding switch controllers may be located outside of the array that includes the radiation-emitting or radiation-responsive electronic component. Again, a viewing or sensing field for the electronic device may not be affected because such switches and switch controllers may be located within the peripheral circuitry. In another embodiment, the switches and corresponding switch controllers may reside on a substrate separate from a substrate having the radiation-emitting or radiation-responsive electronic components.

Portions or all of the methods described herein can be implemented in hardware, software, firmware, or any combination thereof. For software, instructions corresponding to the method can be lines of assembly code or compiled $C^{++}$, Java, or other language code. The code may reside on a data processing readable medium, a hard disk, magnetic tape, floppy diskette, optical storage device, networked storage device(s), random access memory, or other appropriate data processing system readable medium or storage device. The data processing system readable medium may be read by a data processing system, such as a computer, microprocessor, microcontroller, or the like.

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense and all such modifications are intended to be included within the scope of the invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims.

What is claimed is:

1. A circuit for driving an electronic component, wherein the electronic component is a radiation-emitting electronic component or a radiation-responsive electronic component, and wherein the circuit comprises:

the electronic component including a first terminal and a second terminal;

a field-effect transistor comprising a first source/drain region and a second source/drain region, wherein the first source/drain region is connected to the first terminal of the electronic component; and a first signal line connected to the second terminal of the electronic component or the second source/drain region of the field-effect transistor; and a first switch, wherein:

the first switch is connected to the first signal line; and the first switch is configured to allow a state where the first signal line electrically floats.

2. The circuit of claim 1, wherein:

the field-effect transistor further comprises a gate dielectric and a gate electrode, wherein the gate electrode is coupled to a data line.

3. The circuit of claim 2, further comprising a data holder unit having a first terminal and a second terminal, wherein:

the first terminal of the data holder unit is connected to the gate electrode; and the second terminal of the data holder unit is coupled to the first source/drain region or the second source/drain region.

4. The circuit of claim 3, wherein:

the first terminal of the first switch is connected to the second source/drain region and the second terminal of the data holder unit; and a second terminal of the electronic component is connected to a second signal line.

5. The circuit of claim 3, wherein:

the first terminal of the first switch is connected to a second terminal of the electronic component; and the second source/drain region is connected to a second signal line.

6. The circuit of claim 1, further comprising:

a second signal line; and a second switch comprising a first terminal and second terminals, wherein:

the first terminal of the second switch is connected to the second signal line and coupled to a second terminal of the electronic component; and the second switch is configured to allow connection of the first terminal of the second switch to at least one of the second terminals of the second switch.

7. The circuit of claim 1, wherein the electronic component is an organic electronic component.

8. A circuit for driving an electronic component, wherein the electronic component is a radiation-emitting electronic component or a radiation-responsive electronic component, wherein the circuit comprises:

a first signal line;

a first switch comprising a first terminal and second terminals, wherein:

the first terminal of the first switch is connected to the first signal line and coupled to a first terminal of the electronic component; and the first switch is configured to allow connection of the first terminal of the first switch to at least one of the second terminals of the first switch;

a second signal line; and a second switch comprising a third terminal and fourth terminals, wherein:

the third terminal of the second switch is connected to the second signal line and coupled to a second terminal of the electronic component; and the second switch is configured to allow connection of the third terminal of the second switch to at least one of the fourth terminals of the second switch.

9. The circuit of claim 8, wherein the first switch, the second switch, or a combination thereof is configured to allow a state where the first signal line, the second signal line, or a combination thereof electrically floats.

10. The circuit of claim 8, further comprising a field-effect transistor comprising a gate electrode, a gate dielectric layer, a first source/drain region, and a second source/drain region, wherein:

the gate electrode is coupled to a data line;

the first source/drain region is connected to a first terminal of the electronic component;

the second source/drain region is connected to the second signal line; and the second terminal of the electronic component is connected to the first signal line.

11. The circuit of claim 10, further comprising a data holder unit having a first terminal and a second terminal, wherein:

the first terminal of the data holder unit is connected to the gate electrode; and the second terminal of the data holder unit is coupled to the first source/drain region or the second source/drain region.

12. The circuit of claim 8, wherein the electronic component is an organic electronic component.

13. A circuit for driving an electronic component, wherein the electronic component is a radiation-emitting electronic component or a radiation-responsive electronic component, and wherein the circuit comprises:

a first signal line;

a first switch, wherein;

the first switch is connected to the first signal line and is coupled to a first terminal of the electronic component;

the first switch is configured to allow a state where the first signal line electrically floats;

a second signal line; and a second switch comprising a first terminal and second terminals, wherein:

the first terminal of the second switch is connected to the second signal line and coupled to a second terminal of the electronic component; and the second switch is configured to allow connection of the first terminal of the second switch to at least one of the second terminals of the second switch.

14. The circuit of claim 13, further comprising a field-effect transistor comprising a gate electrode, a gate dielectric layer, a first source/drain region, and a second source/drain region, wherein:

the gate electrode is coupled to a data line; and the first source/drain region is connected to a first terminal of the electronic component.

15. The circuit of claim 14, further comprising a data holder unit having a first terminal and a second terminal, wherein:

the first terminal of the data holder unit is connected to the gate electrode; and the second terminal of the data holder unit is coupled to the first source/drain region or the second source/drain region.

16. The circuit of claim 15, wherein:

the first terminal of the first switch is connected to the second source/drain region and the second terminal of the data holder unit; and a second terminal of the electronic component is connected to a second signal line.

17. The circuit of claim 15, wherein:

the first terminal of the first switch is connected to a second terminal of the electronic component; and the second source/drain region is connected to a second signal line.

18. The circuit of claim 13, wherein the electronic component is an organic electronic component.

* * * * *